US012059052B2

(12) United States Patent
Dean et al.

(10) Patent No.: US 12,059,052 B2
(45) Date of Patent: Aug. 13, 2024

(54) FOOTWEAR ENTRY SYSTEM

(71) Applicant: Wolverine Outdoors, Inc., Rockford, MI (US)

(72) Inventors: Martin W. F. Dean, Hemel Hempstead (GB); Clark A. Matis, Durango, CO (US)

(73) Assignee: Wolverine Outdoors, Inc., Rockford, MI (US)

( * ) Notice: Subject to any disclaimer, the term of this patent is extended or adjusted under 35 U.S.C. 154(b) by 50 days.

(21) Appl. No.: 17/879,305

(22) Filed: Aug. 2, 2022

(65) Prior Publication Data

US 2023/0077572 A1 Mar. 16, 2023

Related U.S. Application Data

(60) Provisional application No. 63/242,567, filed on Sep. 10, 2021.

(51) Int. Cl.
*A43B 11/00* (2006.01)

(52) U.S. Cl.
CPC ..... *A43B 11/00* (2013.01)

(58) Field of Classification Search
CPC ..... A43B 11/00
See application file for complete search history.

(56) References Cited

U.S. PATENT DOCUMENTS 5,090,140 A 2/1992 Sessa
5,481,814 A 1/1996 Spencer
6,880,272 B2 4/2005 Wells
7,793,438 B1 9/2010 Busse et al.
8,769,845 B2 7/2014 Lin
9,877,542 B2 1/2018 Pratt
10,306,947 B2 6/2019 Pratt
10,602,802 B2 3/2020 Hopkins
(Continued)

FOREIGN PATENT DOCUMENTS

CN 201931038 5/2011
DE 102009023689 12/2010
(Continued)

OTHER PUBLICATIONS 3 page English translation of DE 202016001813 (Year: 2017).*
8 page English translation of WO 2010139456 (Year: 2010).*
8 page English translation of WO 2014140443 (Year: 2014).*

*Primary Examiner* — Ted Kavanaugh
(74) *Attorney, Agent, or Firm* — Warner Norcross + Judd LLP

(57) ABSTRACT

Footwear can include an upper forefoot part, an upper heel part, an outsole including a forward part joined with the forefoot part and a rearward part joined with the heel part. The rearward part can be selectively moveable in unison with the heel part from a closed mode secured to a wearer's foot, to an open mode to don or doff the footwear. The footwear can include a first shank defining a recess and a second shank including an engagement rim, the second shank tiltable to the open mode, with the engagement rim registered in the recess to stabilize the footwear in the open mode. The upper forefoot part can include one or more pockets, and the heel part can include wings that slidably fit therein. The wings can cooperate to secure the footwear in the closed mode and/or impair overextension in an open mode.

17 Claims, 12 Drawing Sheets

(56) References Cited

U.S. PATENT DOCUMENTS

| | | | | |
|---|---|---|---|---|
| 10,617,174 | B1 | 4/2020 | Hopkins | |
| 10,638,810 | B1 | 5/2020 | Cheney et al. | |
| 10,653,209 | B2 | 5/2020 | Pratt et al. | |
| 10,660,401 | B1 | 5/2020 | Pratt et al. | |
| 10,743,616 | B2 | 8/2020 | Beers et al. | |
| 10,813,405 | B2 | 10/2020 | Pratt | |
| 10,918,160 | B2 | 2/2021 | Hopkins et al. | |
| 2010/0251572 | A1* | 10/2010 | Baudouin | A43B 11/00 36/105 |
| 2015/0020416 | A1* | 1/2015 | Wiens | A43B 11/00 36/102 |
| 2018/0263332 | A1* | 9/2018 | Bruno | A43B 13/189 |
| 2019/0254381 | A1 | 8/2019 | Hopkins et al. | |
| 2020/0085136 | A1 | 3/2020 | Pratt et al. | |
| 2020/0187589 | A1 | 6/2020 | Hopkins | |
| 2020/0187590 | A1 | 6/2020 | Hopkins et al. | |
| 2020/0205512 | A1 | 7/2020 | Blanche et al. | |
| 2020/0229536 | A1 | 7/2020 | Hopkins et al. | |
| 2020/0253333 | A1 | 8/2020 | Kilgore et al. | |
| 2020/0367607 | A1 | 11/2020 | Cheney et al. | |
| 2021/0330033 | A1* | 10/2021 | Pratt | A43B 13/141 |

FOREIGN PATENT DOCUMENTS

| | | | | |
|---|---|---|---|---|
| DE | 202016001813 | U1 * | 7/2017 | |
| WO | WO-2010139456 | A1 * | 12/2010 | A43B 11/00 |
| WO | WO-2014140443 | A1 * | 9/2014 | A43B 11/00 |

* cited by examiner

FOOTWEAR ENTRY SYSTEM

BACKGROUND OF THE INVENTION

The present invention relates to footwear, and more particularly to footwear including an entry system that eases donning and/or doffing of footwear.

Most footwear includes an upper and a sole. The sole forms a wear surface which provides a level of cushion, and in some cases energy return and shock absorption. The upper forms a void within which a wearer positions their foot. The upper typically is configured to close around a portion of the foot, to secure the upper and thus the footwear, to the foot. Some uppers include a closure, such as a lacing system, zipper or strap system, to secure the footwear to the foot. Typically, the wearer must loosen or adjust the closure to enlarge an opening for entry of the foot into the footwear, then don the footwear. Thereafter, the wearer tightens the closure to ensure the footwear will remain secured to the foot. Likewise, to doff the footwear, the wearer again loosens the closure to remove their foot from the void. Most closures require manual manipulation to don or doff the footwear. This can be tedious, and a challenge for wearers with compromised dexterity.

Some footwear manufacturers have attempted to address these issues with certain footwear constructions. In some constructions, the footwear includes an easily collapsible heel that springs back upward after a foot is inserted in the footwear. In other constructions, the footwear includes a heel that folds relative to a forefoot. A flexible band is included to snap the heel against the wearer's heel. The band can stretch to allow the heel to be removed from the wearer's heel. While these constructions can provide easy donning and doffing functionality, they can be overly complicated and sometimes prone to malfunction, alignment issues and premature failure.

Accordingly, there remains room for improvement in the construction of footwear that can be easily donned and doffed to save time and reduce frustration of the wearer.

SUMMARY OF THE INVENTION

A footwear construction is provided including an upper forefoot part, an upper heel part, an outsole including a forward part joined with the forefoot part and a rearward part joined with the heel part. The upper heel part can be selectively moveable in unison with the rearward part of the outsole from a closed mode in which the footwear is secured to a wearer's foot, to an open mode in which the footwear is open to don or doff the footwear.

In one embodiment, the footwear can include a first shank defining a recess and a second shank including an engagement rim. The second shank can be tilted away from a midsole and/or the first shank to the open mode, with the engagement rim registered in the recess to stabilize and/or hold the footwear in the open mode.

In another embodiment, the first shank can include a second recess rearward of the first recess. The second shank can include a projection extending upward therefrom and selectively registerable in the second recess when the footwear is in the closed mode. When the projection is in the second recess, this interlocking of the first and second shank can impair longitudinal sliding of the second shank relative to the first shank in the closed mode. Optionally, the recess and projection can be reversed in their formation relative to the respective first and second shanks.

In still another embodiment, the second shank can include a band or wall that extends upward along and directly engages a rear sidewall of the midsole in the closed mode. The outsole can include its own rear sidewall that is located adjacent and in a fixed relation relative to the band or wall in the closed mode and the open mode, and able to move with the band or wall of the second shank.

In yet another embodiment, the second shank can include a heel aperture rearward of the engagement rim, and forward of the optional upwardly extending band or wall of the second shank. The heel aperture can allow the midsole to move toward an upper surface of the rearward part of the outsole when the footwear is in the closed mode. The first shank optionally can include a corresponding heel aperture aligned with the one in the second shank.

In even another embodiment, the upper forefoot part can include one or more pockets, and the heel part can include wings that slidably fit therein. The wings can cooperate to secure the footwear in the closed mode and/or limit the opening of the footwear in the open mode to impair over-extension of the heel part relative to the forefoot part.

In a further embodiment, the wings can include a first wing and a second wing disposed on opposite lateral and medial sides of the footwear. Each wing can curve inward toward one another over a portion of an instep of the upper to cooperatively secure the footwear in the closed mode.

In still a further embodiment, the pockets can include a first pocket having a first interior panel that faces toward a wearer's foot and a first exterior panel that is spaced from the first interior panel and joined with the first exterior panel. The first wing can be slidably disposed between the first interior panel and the first exterior panel. Further, the second pocket can include a second interior panel that faces toward a wearer's foot and a second exterior panel that is spaced from the second interior panel and joined with the second exterior panel. The second wing can be slidably disposed between the second interior panel and the second exterior panel.

In still yet a further embodiment, the first wing can project farther into the first pocket in the closed mode than in the open mode. Likewise, the second wing can project farther into the second pocket in the closed mode than in the open mode.

In even a further embodiment, the midsole can include a rear sidewall and a heel lock ridge that projects around a portion of the rear sidewall of the midsole. The second shank can include a rearward rim, band or wall that projects upward and includes a heel lock recess. The heel lock ridge snaps into the heel lock recess so as to attain the closed mode. In some cases, the interfitment of the ridge in the recess produces an audible sound to the wearer, thereby confirming to the wearer that the footwear is secured in the closed position and ready for normal activity and use.

In another embodiment, the first shank and the second shank are connected via an axle projecting through at least one of the first shank and the second shank. The axle can be in the form of a rod or one or more pins. Where the axle comprises a rod, it can extend through the first shank and the second shank so that the second shank pivots about a pivot axis relative to the first shank when the second shank tilts away from the midsole. Where the axle comprises one or more pins, it can include a first pin extending into a first aperture on a first side of a longitudinal axis of the footwear, and a second pin extending into a second aperture on a second side of the longitudinal axis.

In still another embodiment, the second shank can include an engagement rim. The first shank can include multiple ridges. The engagement rim can ride over the ridges in transitioning to the open mode, locking adjacent at least one of the ridges when the open mode is attained. The engagement rim can also or alternatively ride over the ridges in transitioning to the closed mode, locking adjacent at least one of the ridges when the open mode is attained.

In yet another embodiment, the first and second shanks can engage one another via a projection in a recess to lock the upper heel part in the open mode relative to the upper forefoot part so that the user can don or doff the footwear. In some cases, when the projection enters the recess, the interaction of the components produces an audible feedback to alert the user that the open mode is fully attained.

In even another embodiment, the first shank can be installed in a midsole recess, while the second shank can include a barn configured to extend around a part of the rear of the midsole when in the closed mode.

The present footwear construction provides benefits in easy donning and doffing of footwear that previously have not been achievable. Where the shank interlocks with first and second recesses, footwear can effectively stabilize in the open mode or closed mode. Where the footwear includes one or more wings that are captured by respective pockets, the footwear can be impaired from over-extending from the open shoe mode. In cases where the wings are inwardly disposed, the wings can further clamp or secure the heel part in place relative to the forefoot part of the footwear in the closed mode to better secure the heel part in that position. In applications where the heel lock is included, that lock can provide a rigid and secure locking for the footwear in the closed mode, yet still provide a durable and wear-resistant lock having an extended wear life. The heel lock also can provide an audible feedback to a wearer to confirm that the footwear is secured in a closed mode for further activity and use.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
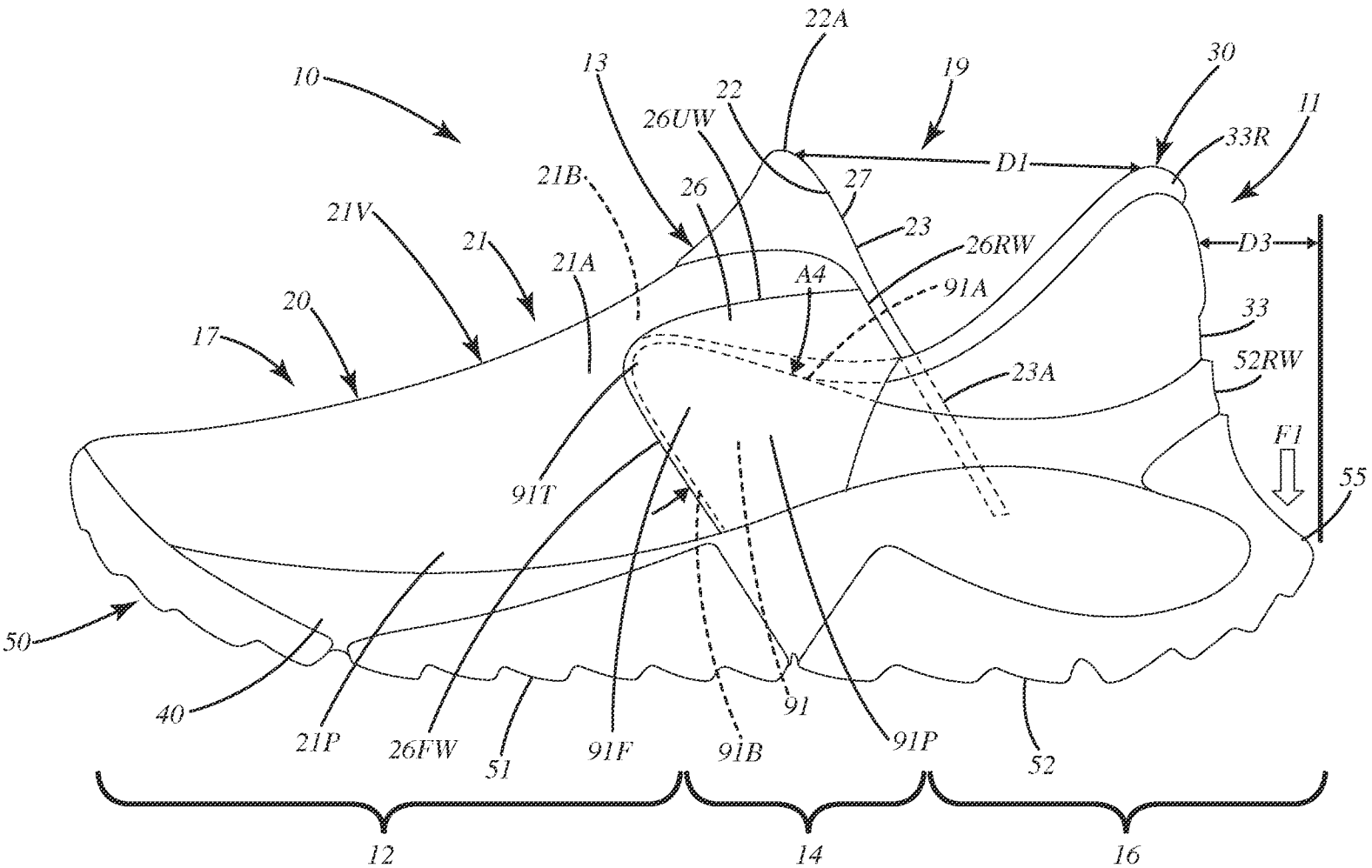
FIG. 1 is a side view of footwear of a current embodiment illustrating the footwear in a closed mode.

A current embodiment of the footwear is illustrated in FIGS. 1-6 and generally designated 10. In this embodiment, the footwear includes an upper 20 having an upper forefoot part 21, an upper heel part 30, a midsole 40 joined with the upper forefoot part 21 and extending rearward therefrom into a heel region, and an outsole 50 including a forward part 51 fixedly joined with the midsole 40 under the upper forefoot part 21 and a rearward part 52 joined with the upper heel part 30. The rearward part 52 is selectively moveable in unison with the upper heel part 30 from a closed mode (FIG. 1) in which the footwear 10 is secured to a wearer's foot, to an open mode (FIG. 2) in which the footwear is open so that the wearer can don or doff the footwear.

Although the current embodiment is illustrated in the context of an athletic shoe, the components, features and function thereof can be incorporated into any type or style of footwear, including performance shoes, trail shoes and boots, work boots, all-terrain shoes, hiking shoes, running shoes, sneakers, conventional tennis shoes, walking shoes, multisport footwear, casual shoes, dress shoes or any other type of footwear or footwear components. It also should be noted that directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe.

Figure 6:
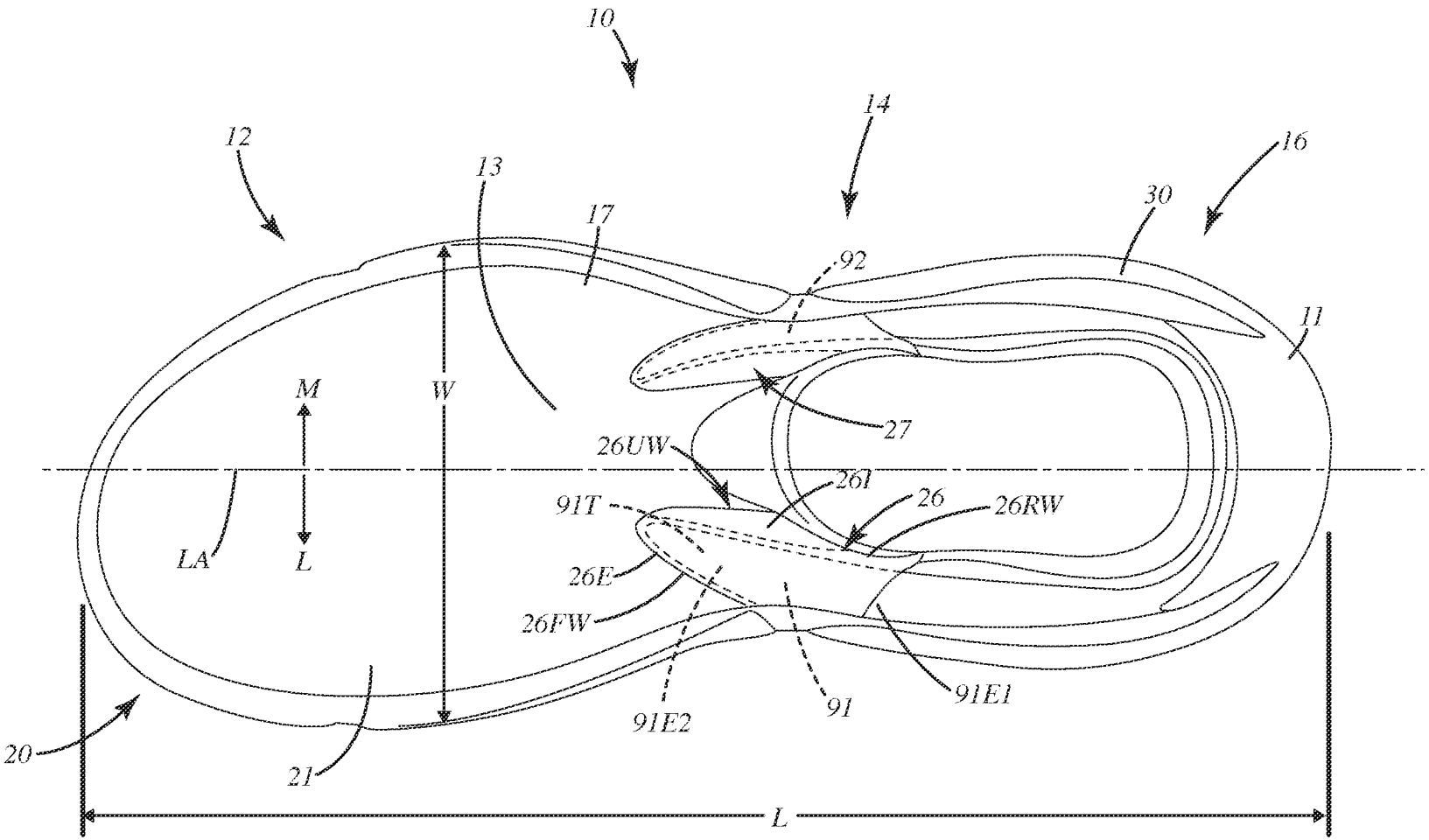
FIG. 6 is a top view of the footwear showing wings positioned relative to an instep in the closed mode.

The use of directional terms should not be interpreted to limit the invention to any specific orientation. Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 12, arch region or mid-foot region 14, and heel region 16 generally are identified in FIG. 1; however, delineation of these regions may vary depending upon the configuration of the sole assembly and/or footwear. Over the arch region 14 and/or part of the forefoot region 12, the footwear can include an instep 13. As shown in FIG. 6, the footwear can include a side-to-side width W, a heel-to-toe longitudinal length L and a longitudinal axis LA, which can be shared with the upper, upper forefoot part, upper heel part, outsole, forward part, rearward part, midsole, first shank, second shank or other components. The footwear can also include lateral L and medial M sides opposite one another across the longitudinal axis LA.

The footwear 10 can include the upper 20 having the upper forefoot part 21, the upper heel part 30, a midsole 40 and/or outsole 50. The upper 20 can be formed from a variety of material elements joined together to cover at least a portion of the wearer's foot. The material elements can be selected based on the intended uses of the article of footwear 10, and can include synthetic textiles, mesh textiles, polymers or leather, for example. Although not shown, the upper 20 can include one or more closure elements, including for example, shoelaces, cords, lace locks and the like (not shown). These closure elements can be tightened a desired amount to conform to a wearer's foot, and left in that configuration indefinitely due to the closing functionality of the footwear via the forefoot part 17 and heel part 11. The upper 20 additionally includes an upper opening 19 for receiving the wearer's foot and a lower periphery for attachment to the sole assembly. This opening 19 can be enlarged from a smaller dimension D1 when the footwear 10 is in the closed mode shown in FIG. 1, to a larger dimension D2 when the footwear 10 is in the open mode shown in FIG. 2 and as described below. This dimension D1 can increase to dimension D2 by optionally at least 10%, at least 20%, at least 30%, at least 40%, at least 50% or at least 60% depending on the application.

A footbed (not shown) can be positioned within the void defined by the upper and can be non-stretchable and lightweight and joined to the upper to provide a void for receipt of the wearer's foot. The footbed can be constructed from a sheet of material, such as foam, EVA, PU, latex, gel or other materials, and by virtue of its compressibility, provide cushioning, and may also conform to the foot in order to provide comfort, support, and stability. The lower peripheral allowance or edge of the upper can be stitched, cemented, or otherwise fastened to the footbed around the perimeter of the footbed. The sole assembly including the midsole and outsole can be combined with any other type or style of upper construction capable of being suitably joined with it, for example, a Strobel construction. The joining of the sole assembly/outsole and the upper can be accomplished using adhesives, cement, injection molding, pour molding or any other technique used to join an upper and sole assembly.

With reference to FIGS. 1-6, the footwear components will now be described in further detail. As mentioned above, the footwear 10 can include an upper 20 having an upper forefoot part 21, an upper heel part 30, an outsole 50 having a forward part 51, a rearward part 52, a midsole 40, as well as a first shank 60 and a second shank 70.

Figure 2:
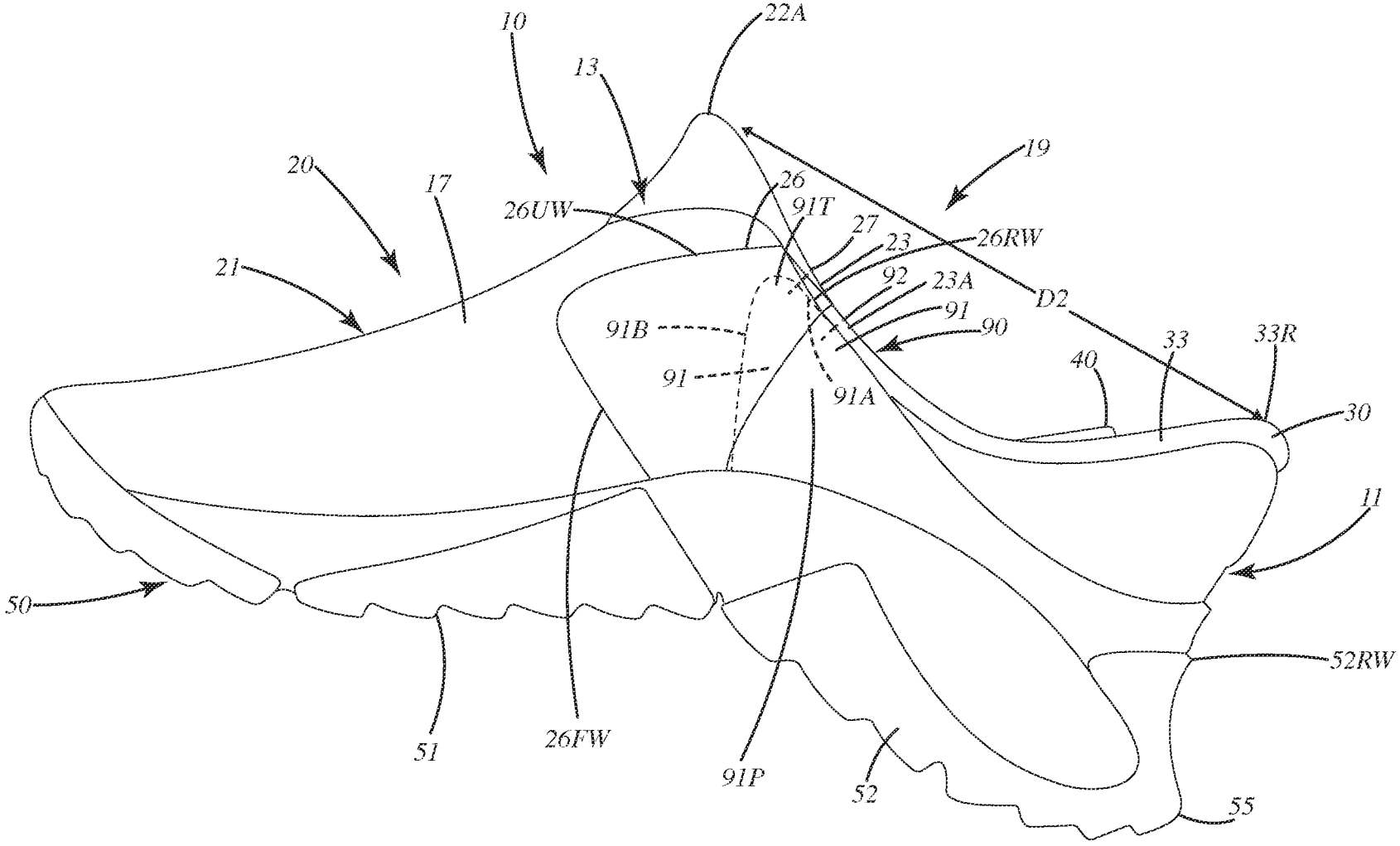
FIG. 2 is a side view of the footwear in an open mode so that the footwear can be easily donned or doffed.
Figure 3:
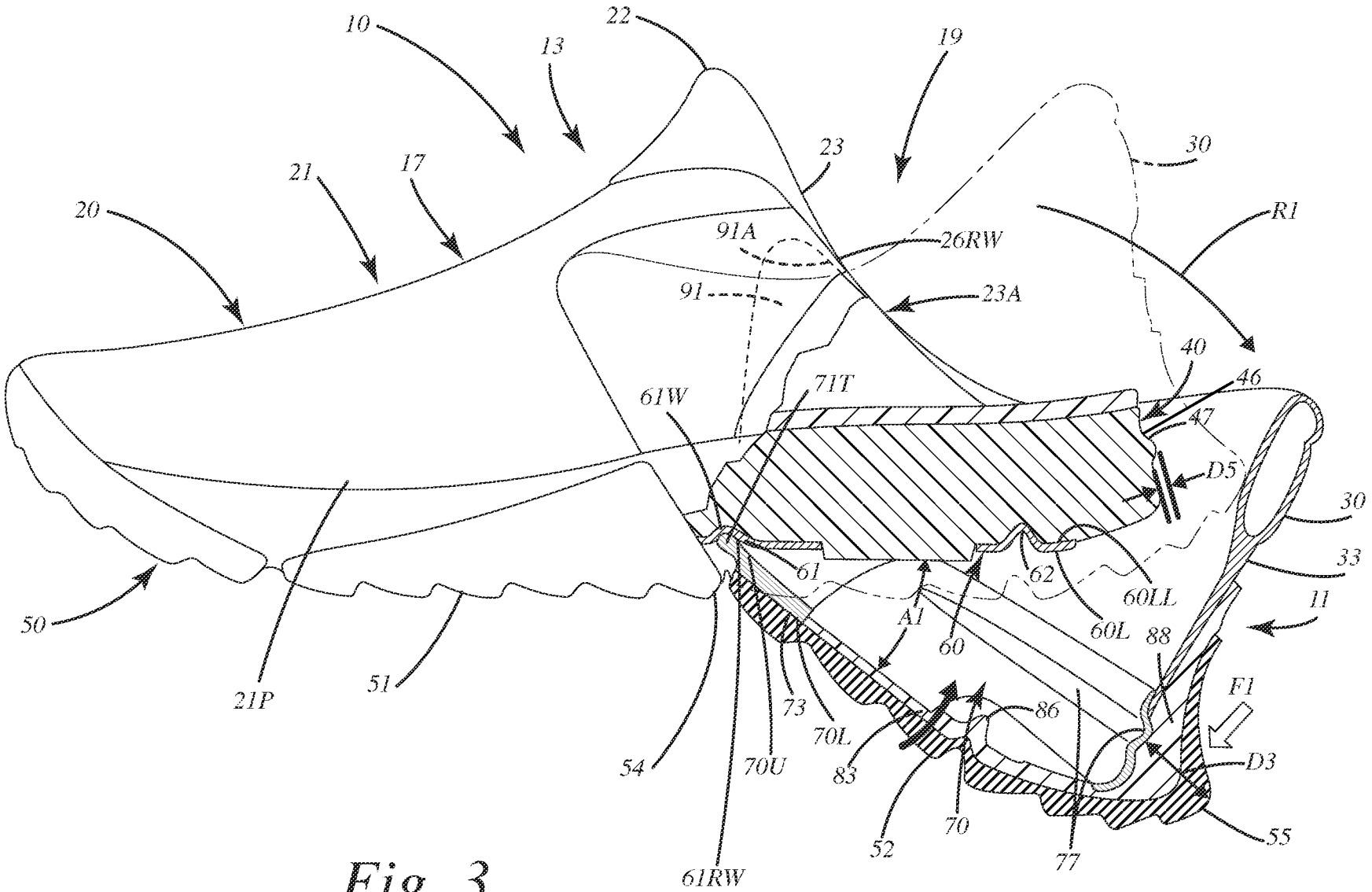
FIG. 3 is a partial section view illustrating the footwear in the open mode, with the shank in a first recess to stabilize the footwear in the open mode.

With reference to FIGS. 1-3, the upper forefoot part 21 can be joined with the forward part 51 of the outsole 50. These components can form the forefoot part 17 of the footwear. The upper forward part 21 can include a portion of a vamp 21V and lateral and medial quarter panels 21A and 21B extending downwardly toward a peripheral allowance 21P that is joined with a portion of a midsole 40 that may itself be joined directly with the outsole 50, and particularly forward part 51 of the outsole 50. The upper forefoot part 21 can extend upwardly to a first collar portion 22. This first collar portion 22 can extend and transition downwardly along an upper forefoot edge 23. This edge 23 can extend downward to and transition to the midsole 40 and in some cases can be joined and secured thereto in the heel region 16. A portion of the edge 23A can be concealed by the upper heel part 30 when the footwear is in the closed mode shown in FIG. 1, but exposed from a side view when the footwear is in the open mode shown in FIG. 2. This edge 23A thus can be selectively concealed or exposed when the footwear is viewed from a side view of the footwear.

The upper forefoot part 21 can be joined with the forward part 51 of the outsole, optionally with the midsole 40 being disposed there between or adjacent to at least one of these components. Generally, the upper forefoot part 21 does not move relative to the forward part 51 of the outsole 50. These components can remain stationary and fixed relative to one another in the open and close modes. Likewise, the upper forefoot part 21 and lower periphery 21P can be fixedly and securely joined to the midsole 40 throughout the forefoot portion 12 and at least a portion of the arch region 14 and in some cases the heel region 16. Optionally, the upper forefoot part 21 does not wrap around the rearmost extremity of the midsole and/or outsole in the heel region 16.

The upper 20 also can include the upper heel part 30 which extends within the heel region 16 and in some cases a portion of the arch region 14 and/or slightly into the forefoot region 12. The upper heel part 30 can include a heel part collar 33 that extends around the rearward portion of the heel region 16 of the footwear and the opening 19 in general, at least in the closed mode shown in FIG. 1. The upper can also overlap and can be transverse relative to the edge 23 and the edge portion 23A. As shown in FIG. 3, the heel part collar 33 can move relative to the edge portion 23A to expose more and more of that edge portion 23A as the heel part moves during transition of the footwear from the closed mode shown in FIG. 1 to the open mode shown in FIGS. 2-3.

The rearward most portion 33R of the collar 33 also can move relative to the instep apex 22A of the collar 22. For example, as shown in FIG. 1, the rearward most portion 33R is disposed at a distance D1 from the apex 22A when the footwear 10 is in the closed mode shown there. However, when the footwear transitions to the open mode shown in FIGS. 2 and 3, the rearward most portion 33R moves away from the apex 22A to increase the distance D1 to a greater distance D2. In turn, this increases the overall area of the opening 19 such that a user can easily don or doff the footwear 10 relative to the wearer's foot. In other words, the entry to the opening 19 becomes larger in transitioning from the closed mode in FIG. 1 to the open mode in FIG. 2.

As shown in FIG. 3, the upper heel part 30 can be joined as well to the outsole 50 and in particular the rearward part 52 of the outsole. The upper heel part 30 can extend upward and around the heel of the wearer to secure the footwear 10 to the wearer's foot when the footwear is in the closed mode shown in FIG. 1. The upper heel part 30 can transition downward to the outsole and can be at least partially covered by an upstanding rear wall 52RW of the rearward part 52 of the outsole. This outsole rear wall 52RW can be of a thickness of optionally at least 0.5 mm, at least 1 mm, at least 1.5 mm, at least 2 mm, at least 2.5 mm, at least 3 mm, at least 4 mm. The wall 52RW can extend around the rearward wall of the upper heel part, around a band 73 of the second shank, and/or around a rear wall 88 of a wing chassis as described below.

Optionally, the wall 52RW can transition downward to an actuator ledge 55 of the outsole. This actuator ledge 55 can be sized and configured to project outwardly distance D3 from the rearward wall of the upper heel part 30 such that a user can engage the ledge with the force F1, optionally manually or with an opposing foot, to forcibly rotate the upper heel part 30 downward in direction R1 as shown in FIG. 3. With this movement, the footwear can be converted to an open mode from a closed mode to increase the overall dimension and area of the opening 19.

Figure 4:
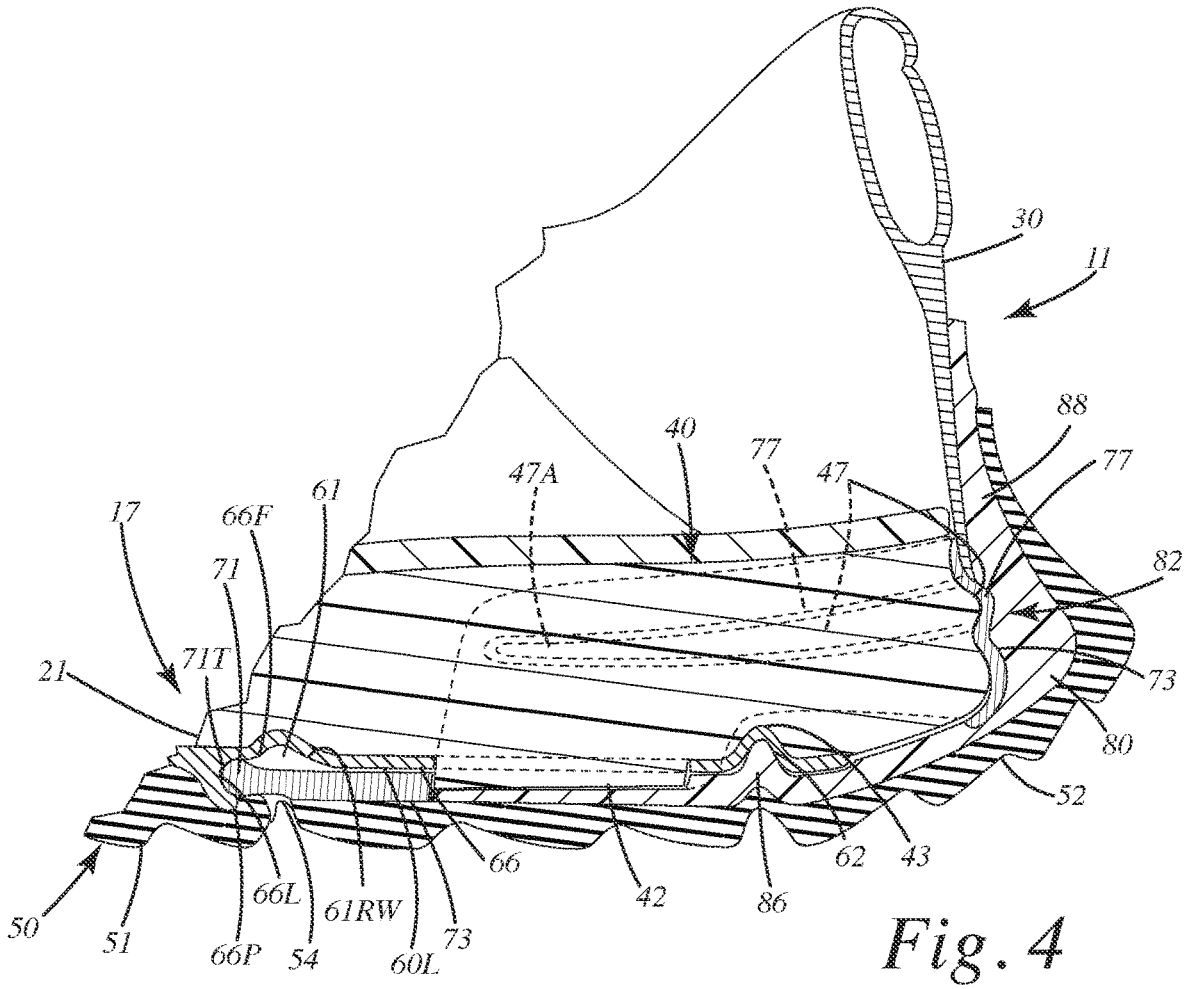
FIG. 4 is a partial section view illustrating the footwear in the open mode, with the shank in a second recess to stabilize the footwear in the closed mode.
Figure 5:
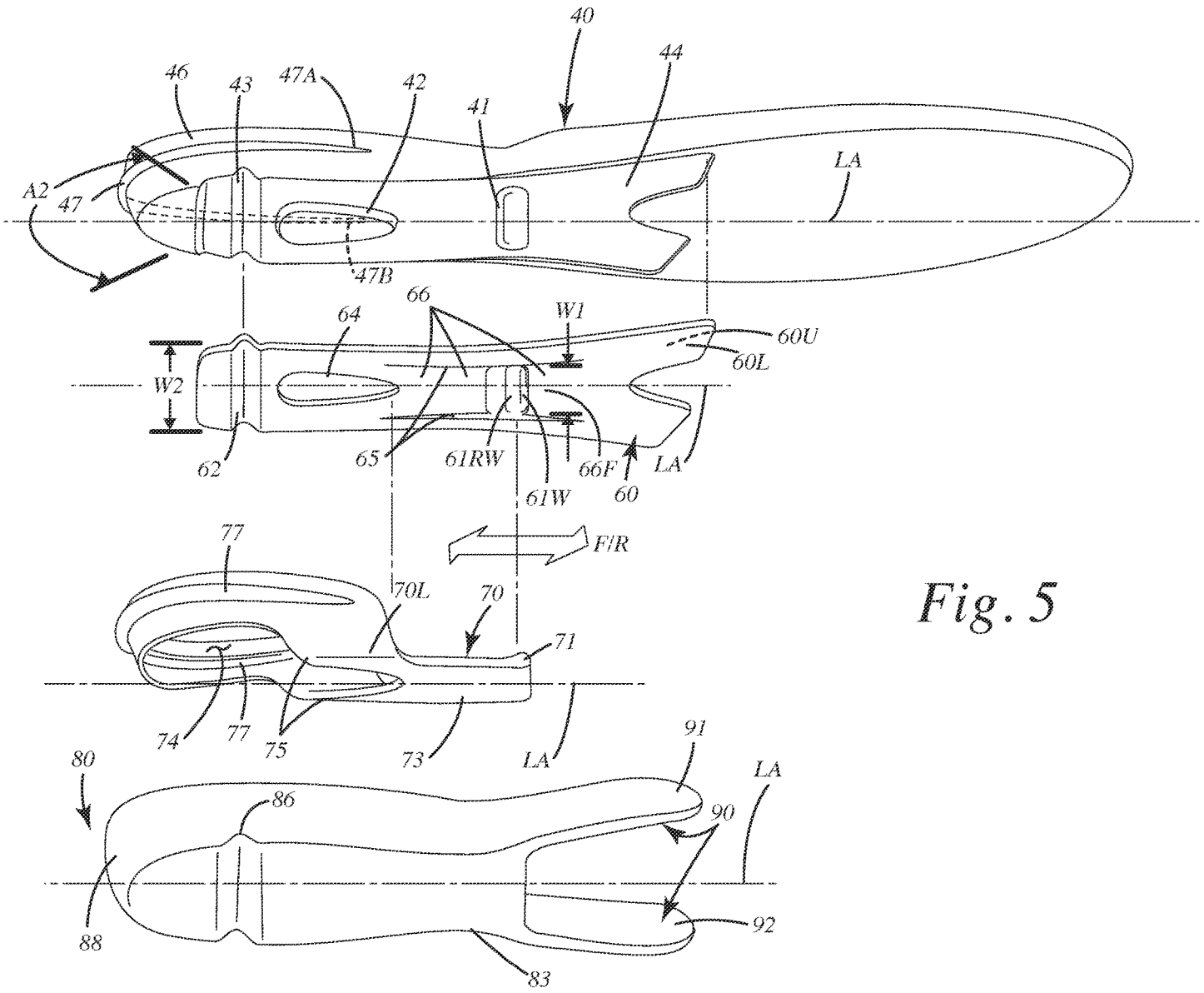
FIG. 5 is an exploded lower perspective view of the footwear and its components.

As shown in FIGS. 3, 4 and 5, the outsole 50 can include the above-mentioned forward part 51 and rearward part 52. The forward part 51 can be fixedly joined with the midsole under the upper forefoot part 21. The rearward part can be joined with the upper heel part 30. The forward part and a rearward part of the outsole can be joined at a flex or transition region 54, which optionally can be disposed in the arch region 14, generally under the instep 13 of the footwear. This flex region 54 can bend, flex, deform or otherwise be modified (all referred to as flex herein) so as to allow the outsole 50 to articulate, bend, rotate or move in the arch region so that the heel part 11 can move from the open mode to the closed mode relative to the forefoot part 17 and vice versa. This flex region can be a substantially flat region or can be located between lugs. As shown, there is no groove and/or recess disposed at the flex region 54. This region can be optionally flat and/or planar and can extend upwardly along at least a portion of the midsole 40. Of course in other cases, the flex region can include a groove, for example, a triangular or rounded groove, recess or channel in this flex region 54 to facilitate and/or control flexure or bending of the rearward part relative to the forward part of the outsole. Optionally in some applications, this flex region 54 can be absent, and the forward part and rearward part of the outsole can be separate components distanced from one another by a slot or recess, and joined to flex or move relative to one another with another component.

With further reference to FIGS. 3-5, the footwear 10 can include a first shank 60 and a second shank 70 that are movable relative to one another as shown. The second shank 70 can move with the upper heel part 30 and the rearward part 52 of the outsole in transitioning from the closed mode to the open mode as described further below. As shown in FIG. 5, the first shank 60 can extend within the heel region 16 and forwardly into the arch region 14 of the footwear. The first shank 60 can include a heel recess, opening or aperture 64 located in a rearward-most portion of the shank. This heel opening 64 can enable a heel button 42 of the midsole 40 to project outwardly at least partially into the first shank 60. This heel button 42 can be a raised surface that projects at least partially through the heel opening 64, which optionally can surround the heel button in so doing.

The first shank 60 optionally can include a first recess 61. This first recess 61 can be disposed above the portion of the rearward part 52 of the outsole 50 and generally above the second shank 70. The first recess 61 can extend laterally and transversely relative to the longitudinal axis LA of the first shank 60. The first recess 61 can be an indentation or rounded channel or groove that is reflected from the undersurface 60L through to the upper surface 60U of the first shank 60. The first recess 61 can be defined between opposing guide walls 65 that are disposed on opposite sides of longitudinal axis LA. The guide walls 65 can constrain movement of and guide there between a portion of the second shank 70 as it tilts, pivots or moves relative to the first shank as described below. The guide walls 65 can extend adjacent and forward of the heel opening 64. In some cases, the guide walls 65 can extend forward of the first recess 61 such that a depression or recess 66 is formed rearward of and forward of the first recess 61. This recess 66 optionally can include a forward part 66F within which a portion of the second shank, for example, an engagement rim 71, can be disposed when the footwear is in the closed mode as described below.

Optionally, the first shank 60 can extend rearward from the first recess 61 and the heel opening 64. A rearward part of the first shank can define a second recess 62 that extends laterally and transversely relative to the longitudinal axis LA. The second recess 62 can have a greater width W2 than the width W1 of the first recess 61. This recess 62 can be reflected upward and can be defined by a portion of the first shank 60 that extends upwardly above the upper surface 60U of the first shank 60. Of course, in cases where the first shank is a thicker piece of material or element, the first and second recesses 61 and 62 can be defined by the lower surface, without reflecting in the upper surface 60U of the first shank 60.

The first shank, as well as the second shank can be constructed from a rigid polymeric material and in some cases nylon, composites, metal and/or mixtures thereof. These components can be relatively stiff and can have a low elasticity.

Optionally, the midsole 40 can be configured to include a first shank recess 44 that accommodates the contours in shape of the first shank 60. As shown in FIG. 5, the midsole also can include a first recess 41 and a second recess 43 which can respectively receive portions of the first shank where the first recess 61 and second recess 62 thereof are formed and/or reflected through the upper surface 60U of the first shank 60. These respective recesses 61 and 62 can interlock an inner fit within the recesses 41 and 43 of the midsole 40. The overall shank 60 also can fit within the larger recess 44. In some cases, the shank 60 can be molded, glued, cemented, welded or otherwise joined to the midsole to secure these two components together. The midsole also can extend forward of the first shank 60, into a forefoot region of the footwear depending on the application. In other applications, the midsole might be absent altogether, with the shank having a cushioning feature associated with it to function as a midsole.

The second shank 70 can be disposed generally adjacent the first shank in the closed mode but can be configured to tilt, move, float, readjust or modify (all referred to as tilt) away from the first shank in transitioning from the closed mode to the open mode. The second shank 70 can include a forward extension 73 that transitions to an upwardly projecting wall or band 73 that can extend away from the forward extension 73 and then back toward it to connect to the forward extension at respective lateral first and second plates 75. The second shank 70 can include and define another heel opening 74 that can be aligned with the heel opening 64 of the first plate. In this manner, the heel button 42 of the midsole can project outwardly and move toward and/or through at least a portion of the opening 74 and the second shank when the footwear is in the closed mode.

The forward extension 73 can extend forwardly to an engagement rim 71. This engagement rim 71 can extend laterally across and transverse to the longitudinal axis LA. In some cases, the engagement rim 71 can be perpendicular to the longitudinal axis, as can be the first recess 61. Generally, the engagement rim and the first recess 61 can be aligned and parallel with one another in both the open mode and the closed mode. The engagement rim 71 can be configured to slide and move into and out from the first recess 61 in transitioning to or from the open mode. For example, as shown in FIG. 3, the engagement rim 71 can be configured to register in the first recess 61 to stabilize the footwear in the open mode so that the footwear remains in the open mode shown there in solid lines. The engagement rim 71 specifically can project upwardly into the first recess 61 such that the end or tip 71T of the engagement rim 71 is disposed above the lower surface 60L of the first shank 60. The tip 71T can directly engage the forward wall 61W of the recess 61 while optionally the upper surface 70U of the second shank can engage and/or contact to the rearward wall 61RW of the recess 61 in this open mode. In this mode, with the interaction of the engagement rim in the first recess, the first shank 60 in the second shank 70 can be disposed at and held at an angle A1 relative to one another. This angle A1 can be an acute angle, for example, optionally about 10° to about 89°, about 10° to about 80°, about 15° to about 60°, about 30° to about 45°, or about 35°, depending on the application and the suitable size of the opening 19 to provide easy donning and doffing of the footwear 10.

The second shank 70 also can be configured to tilt toward the first shank and transition to the closed mode. For example, as shown in FIGS. 3 and 4, the second shank can tilt to move in direction R2 toward the first shank 60 to transition to the closed mode. This direction R2 can be opposite the direction of rotation R1 when the heel part transitions to the open mode. The angle A1 becomes smaller in this transition in direction R2.

Optionally, as the heel part transitions to the closed mode, the engagement rim 71 can begin to decrease its depth or penetration into the first recess 61. In some cases, as shown in FIG. 4, the engagement rim 71 can exit the first recess 61. In so doing, the tip can slide along the forward wall 61W of the recess, and optionally along the forward portion 66F of the recess 66 defined in the lower surface 60L of the first shank 60. Optionally, the tip 71T of the engagement rim 71 can completely exit the recess 61 and can ride forwardly and/or slide against the forward portion 66F of the recess 66. Further optionally in some applications, the first shank can include a protrusion 66P (shown in broken lines in FIG. 4) that forms a pocket 66L between the lower surface 60L and/or the portion of the forward recess 66F and that projection 66P. The engagement rim 71 and optionally the tip 71T can fit into this pocket 66L to trap the forward extension 73 and engagement rim 71 of the second shank 70. This can impair longitudinal movement of the second shank relative to the first shank, the midsole and the remainder of the footwear in general when the footwear is in the closed mode.

As mentioned above, the first shank 60 can include a second recess 62 defined rearward of the first recess 61. The footwear can also include a wing chassis 80. The wing chassis can include a secondary projection or ridge 86. The projection or ridge can extend across the longitudinal axis LA. The projection can be selectively registrable in the second recess 62 of the first shank to impair longitudinal sliding of the second shank 70 relative to the first shank 60 in the closed mode, due to the second shank being secured to the wing chassis. In particular, the second shank can be impaired or prevented from sliding in a forward or rearward in directions F/R as indicated in FIG. 5. This can prevent the longitudinal movement of the first and second shanks relative to one another when the footwear is in the closed mode and in normal use. Optionally, additional recesses and projections can be formed on the respective first and second shanks to impair this relative movement and/or sliding in the longitudinal direction. Further, the projections and recesses can be configured with projections being formed on the first shank and the recesses formed in the second shank (not shown). Other bumps, dimples, ridges, serrations or other contours can be added to the respective first and second shanks to impair relative longitudinal sliding or movement, or other lateral movement, of the shanks relative to one another.

Optionally, the footwear 10 can be outfitted with a heel lock 82 to further lock or register the heel part 11 in a closed mode relative to the forefoot part 17. For example, as shown in FIG. 3, the midsole can include a rear sidewall 46 that extends rearwardly around the heel region 16 of the footwear. This rear sidewall 46 can further include at least one heel lock ridge 47 that projects upwardly a distance D5 from the remainder of the rear sidewall. This heel lock ridge 47 can be of a variety of contours. For example as shown, the heel lock ridge can be optionally rounded, partially semi-circular, angled, triangular, polygonal or of other shapes that extend outwardly from the rear sidewall. The heel lock ridge 47 can also project about the rear sidewall at an angle A2 that traverses the longitudinal axis LA as shown in FIG. 5. The angle A2 can be optionally at least 45°, at least 60°, at least 90°, at least 110°, between 90 and 180°, between 90 and 120°, or about 110°. The heel lock ridge 47 can transition forwardly and taper downward at its respective forward ends 47A and 47B into the rear sidewall 46.

In some applications, the heel lock ridge 47 can be formed with the same material as the midsole 40, and can be a projection that is integral with the remainder of the midsole. Where the midsole 40 is constructed from a relatively low durometer material, the rear sidewall and/or the heel lock ridge can be covered or coated with a film or additional layer. For example, the heel lock ridge 47 can include a projection that extends outwardly from the body of the midsole, with a film or coating of TPU, PU, ESS or some other polymeric or composite material to make the heel lock ridge more rigid, durable and wear resistant. This material also can be of a greater durometer than the remainder of the midsole 40.

The heel lock ridge 47 can be configured to nest and fit into corresponding heel lock recess 77 that is defined by the second shank 70, and optionally the upstanding rearward wall or band 73 that extends around at least a portion of the heel of the footwear. As further shown in FIG. 3, the heel lock recess 77 can be defined in the band 73 and optionally can extend a similar angle A2 about the second shank and heel in general. This heel lock recess 77 can be of a similar contour in cross-section and shape as the heel lock ridge 47 so that the heel lock ridge can fit within and securely lock therein to hold the footwear and its components in the closed mode shown in FIG. 1.

The heel lock ridge and recess also can be configured to slide relative to one another. For example, as mentioned above, when a force F1 is applied to the ledge 55 or other component of the heel part 11, the sidewalls of the recess can slide relative to the surfaces of the ridge 47 until the ridge 47 exits the recess 77 to allow the rear of the footwear to transition to the open mode.

In some applications, the footwear can be configured to provide audible feedback indicating that the footwear is in a thoroughly locked closed mode, that is, the heel part and forefoot part are fully closed and engaged. In this closed mode, the footwear is ready for regular activity and use. To provide audible feedback, the heel lock ridge and heel lock recess can be configured to provide an audible snap, click, crack, pop or other sound (all referred to as an audible snap) when the ridge 47 adequately enters the recess 77. The audible snap also can be augmented optionally by contact between the lower surface 60L of the first shank and an upper surface 70U of the second shank slapping, contacting or engaging one another when the shanks are flattened and lay adjacent or against one another in the closed mode. It will be appreciated that the footwear 10 also can provide audible feedback, such as an audible snap, when the footwear is transitioned out of the closed mode to the open mode. The audible feedback indicating the closed mode or the open mode can be slightly different types or volumes of sound so that a user can distinguish between the respective modes.

As shown in the figures, the footwear 10 optionally can include a system of wings and pockets that provide functionality in the opened and/or closed modes of the footwear. For example, the upper heel part 30 can include wings 90, optionally including a first wing 91 on a lateral side L of the footwear and a second wing 92 on opposing medial side M of the footwear. These wings can be configured to fit within and move within the respective first 26 and second 27 pockets. The wings optionally can be configured to wrap toward and/or over a portion of the instep 13 of the footwear when it is in the closed mode. The wings generally assist in holding the heel part 11 in a fixed, close position relative to the forefoot part 17 of the footwear 10. The wings 91 and 92 can impair or prevent the overextension of the heel part 11 relative to the forefoot part 17 of the footwear 10 when the footwear is transitioned to the open mode shown in FIG. 2. This can prevent or impair the heel part 11 from flopping too far away from the forefoot part and becoming disabled in operation of the footwear 10.

Particularly, with reference to FIGS. 1, 2, and 5, the upper forefoot part 21 can define a first pocket 26 and a second pocket 27 on opposite sides of the longitudinal axis LA of the footwear. The upper heel part 30 can include a first wing 91 and a second wing 92 that can respectively register in the first pocket 26 and the second pocket 27. The upper heel part can be disposed in the heel region. The first wing and second wing can extend forwardly from the heel region 16 and/or arch region 14 into the arch region 14 and optionally slightly into the forefoot region 12 of the footwear.

Although mentioned as being included in the upper heel part 30, the wings 91 and 92 optionally can be formed as a portion of the outsole and/or a wing chassis 80 as shown in FIG. 5. The wing chassis can be formed of a rigid polymeric material, for example TPU or some other polymer that is relatively rigid and stiff. The first wing 91 and second wing 92 can extend from a base plate 83 that connects the wings and that extend under the lower surface 70L of the second shank 70. In some cases, this plate 83 can define a chassis projection 86 that corresponds to the recess 62 in the shank 60. The wing chassis 80 also can extend rearward and upwardly about and around the upward extending band or wall 73, and rearward of the heel lock recess 77 formed in that band. The plate 83 can include an upward extending wall 88 that extends upward from the shank 70 and is disposed between the shank 70 and the rearward wall of the outsole, in some cases above the optional ledge 55.

The first and second wings can be similar in structure so only the first wing 91 will be described here. Generally, the first wing can extend upwardly and forwardly away from the rearward part 52 of the sole. The first wing 91 can extend and conform to a generally triangular shaped forward portion 91F that extends to a tip 91T. The tip can transition rearward toward the upper heel part along the edges 91A and 91B. These edges can form an angle A4. This angle A4 can be optionally an acute angle, further optionally between about 10° and about 89°, between about 20° and 70°, between about 30° and about 60°, or between about 30° and 45°, depending on the application. The wing 91 can be rigid and stiff and can be extended from the chassis 80 at a slightly outward extending offset angle A5 as shown in FIG. 5. This angle A5 can be an acute angle, for example between about 10° and about 89°, between about 10° and about 25°, or about 20°, depending on the application. This angle A5 optionally can allow the wing to extend outward in a manner similar to the way a forefoot of the human foot becomes wider as it extends away from the heel of the foot. This outward angle also can cause the wings to bind against an exterior panel of the respective pockets to assist in limiting movement of the wings in some cases.

The first 91 and second 92 wings can extend into and can be slidably received within the first pocket 26 and the second pocket 27 associated with the forefoot part 17. Each of the first and second wings optionally can project farther into the first and second pockets in the closed mode than in the open mode. For example, there can be more of the plate section 91P of the wing disposed in the pocket in the closed mode than in the open mode. In some cases, there can be optionally at least 10%, at least 20%, at least 30%, at least 40%, at least 50% or more of the plate 91P disposed pocket in the closed mode than in the open mode.

With reference to FIGS. 1, 2 and 6, the respective pockets will be described in more detail, focusing on the first pocket 26. The second pocket 27 can be virtually identical thereto except located on the opposite side of the shoe. The first pocket 26 can include a first interior panel 261 that faces toward a wearer's foot and toward the internal void defined by the footwear 10. The first pocket also can include a first exterior panel 26E that is spaced from the first interior panel 261. The first exterior panel 26E can face upwardly, away from the upper and in particular the upper forefoot part 21. The first exterior panel can be opaque, or in some cases can be translucent and/or transparent so that the position of the wing 91 disposed therein can be readily discerned by viewing the wing through the exterior panel. The first interior panel and first exterior panel can be joined to one another around the periphery of the pocket 26. Each of the interior panels and exterior panels can include inner surfaces that face toward one another and can define a void in the pocket within which the wing 91 can be positioned.

The first pocket 26 can include an upper wall 26UW that generally extends toward the collar 23 of the upper forefoot part 21 as shown in FIGS. 2 and 6. This upper wall 26UW can be curved so that the tip 91T of the first wing 91 can slide easily relative to it. The pocket 26 also can include a rearward wall 26RW that transitions to the upper wall 26UW at its rearwardmost extent. This wall 26RW can extend downwardly and optionally parallel to the contour of the collar edge 23. This rearward wall can be transverse to the upper wall 26UW. This rearward wall 26RW can form a stop wall or limit wall, against which the tip 91T of the first wing 91 engages when the footwear achieves the open mode shown in FIG. 2. The stop wall can limit movement of the heel part 11 relative to the forefoot part 17 so that the heel part is not overextended or opened too widely, for example, beyond what is suitable for the footwear. As shown in FIG. 2, the rear wall 26RW of the pocket 26 can extend downward a sufficient distance to act as a catch for the tip 91T such that the upper edge 91A of the plate 91P engages that rearward wall 26RW to stop or limit further movement of the heel part 11 after the open mode is achieved. Of course, when the footwear is converted from the open mode to the closed mode, the tip and/or plate can disengage the stop wall and slide toward the forward wall 26FW of the pocket.

Optionally, the upper wall 26UW of the pocket 26 can transition to the forward wall 26FW that is forward of the rear wall and optionally parallel to the rearward wall 26RW. That forward wall 26FW can be positioned and oriented such that the wing 91 can engage the forward wall 26FW when the heel part 11 is adequately in the closed mode and the optional heel lock 82 is engaged. In some applications, the forward edge 91B of the wing plate 91P can engage that forward wall in the closed mode. In other cases, the tip 91T can engage that forward wall or a portion of the upper wall 26UW of the pocket in the closed mode. Of course, where the wing 91 is a different shape than that shown, the pocket can include walls that are oriented differently relative to one another and of different shapes and sizes.

As shown in FIG. 6, it is also contemplated that in some applications, the first wing 91 and second wing 92 can curve inward toward one another and/or toward the longitudinal axis LA as the wings extend farther above the outsole 50. These wings optionally can clamp downwardly on the portion of the instep 13 to further assist in cooperatively securing the footwear in the closed mode. As an example, the first wing 91 can include a first end 91E1 and a second end 91E2. The first end 91E1 can be secured to the rearward heel part and/or the wing chassis 80. The second end 91E2 can extend forwardly of the first end and can extend in the first pocket 26. This second end 91E2 can extend inwardly toward the longitudinal axis LA of the upper. In some cases, the second end 91E2 can be closer to the longitudinal axis LA than the first end 91E1. Optionally, the second wing can likewise include first and second ends oriented similarly.

Each of the second ends of the first and second wings can curve inward toward one another, over a portion of the instep 13. Due to the extension or inward curving of these ends and the wings toward one another, the wings can cooperatively secure the footwear in the closed mode, clamping over and down on the instep in some cases. This closure function of the wings can supplement the heel lock features mentioned above. Of course, in other applications, the wings 91 and 92 can extend generally parallel to the upper surfaces of the upper without extending or curving inward toward the longitudinal axis LA thereof.

A second alternative embodiment is shown in FIGS. 7-12 and generally designated 110. This embodiment can be similar in structure, function and operation to the embodiment described above with several exceptions. For example, this footwear 110 can include a forefoot part 117 and heel part 111. The upper 120 can include an upper opening 119 for receiving the wearer's foot. This opening 119 can be enlarged from a smaller dimension D1 when the footwear 110 is in the closed mode shown in FIG. 11, to a larger dimension D2 when the footwear 110 is in the open mode shown in FIG. 12, so that a user can easily don and doff the footwear, as described in connection with the embodiment above.

The footwear 10 shown in FIGS. 7-10 also can include a midsole 140 similar to that described in the embodiment above, which can be connected to the upper forefoot part 120. The midsole 140 can define a first shank recess 144, having a first subpart recess 144A and a second subpart recess 144B rearward thereof. The first subpart 144A can extend in the arch and forefoot portion of the midsole, without extending to the outer edges 142E of the midsole. The second subpart recess 144B of the recess 144, however, can extend to the edges and can result in the heel part of the midsole having a narrower profile than the forefoot part of the midsole. The first subpart recess 144A can be configured to receive a part or plate 160P of the first shank 160 therein. That plate 160P can be adhered, cemented, glued or otherwise fastened into the first subpart recess 144A of the recess to hold it in place. The first shank can thus be fixedly and securely joined with the midsole in the recess subpart 144A. Optionally, the plate and first subpart recess 144A can be similarly shaped, so that the plate nests within the recess to prevent or impair it from rotating or moving. The plate also can be substantially rigidly secured in the recess so that it does not move when the second shank moves relative to the first shank in transitioning between the open and closed modes. The plate further optionally can be flush mounted with the surrounding lower surface 140L of the midsole 140 so that it does not protrude much or at all below that lower surface. Thus, when the outsole 150 is secured to the lower surface, the plate does not create a bump or protuberance in the region where it is disposed.

Figure 11:
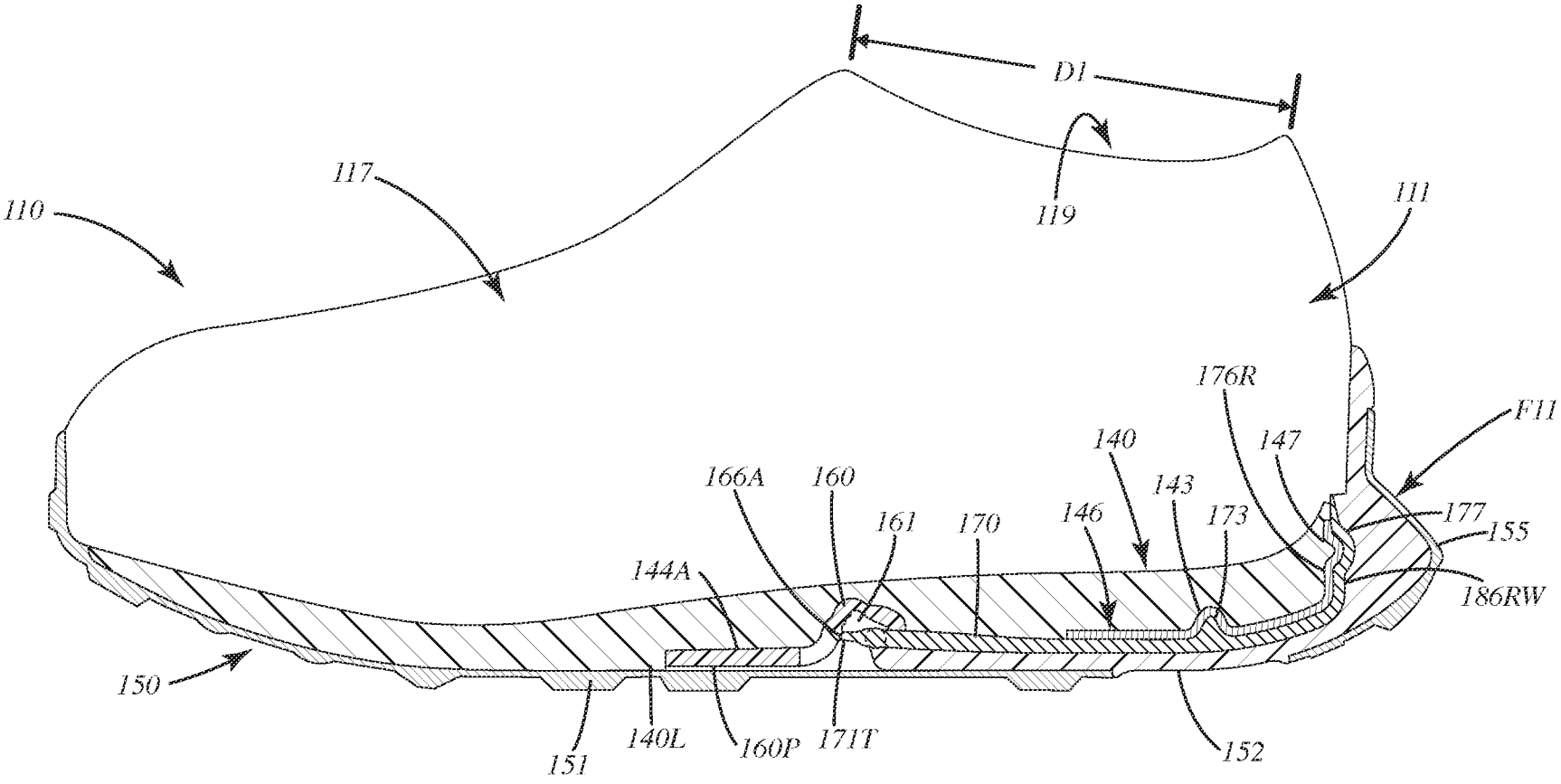
FIG. 11 is a section view of the first and second shanks locking the footwear in the closed mode.

The second subpart recess 144B can be configured to receive at least a part of the second shank 170, which as described below, can be movably, pivotally and/or hingedly joined with the first shank 160 in this embodiment. The midsole 140 optionally can include a midsole heel cup 146 extending around a rear of the midsole. The midsole heel cup 146 can extend around the rear of the heel region 16 of the midsole. The midsole heel cup 146 can be constructed from a plastic or polymeric material such as TPU, polyamide 6,6, polyethylene, polypropylene, or some other relatively rigid or sturdy polymer. The midsole heel cup in this construction can itself include the least one heel lock ridge 147 that projects outwardly from the remainder of the rear sidewall of the midsole heel cup 146. This heel lock ridge 147 can be of a variety of contours. For example as shown, the heel lock ridge can be optionally rounded, partially semicircular, angled, triangular, polygonal or of other shapes that extend outwardly from the rear sidewall. The heel lock ridge 147 can also project about the rear sidewall of the midsole at an angle that traverses the longitudinal axis, where that angle can be equal to the angle A2 described in the embodiment above. The heel lock ridge 147 can be configured to nest and fit into corresponding heel lock recess 177 that is defined by the second shank 170, and optionally the upstanding rearward wall 186RW that extends around at least a portion of the heel of the footwear as shown in FIG. 11 when the footwear is in the closed mode Like the embodiment above, the heel lock recess 177 can be of a similar contour in cross-section and shape as the heel lock ridge 147 so that the heel lock ridge can fit within and securely lock therein to hold the footwear and its components in the closed mode shown in FIG. 11.

The heel lock ridge 147 and recess 177 can be configured to slide relative to one another, similar to the embodiment above. For example, as mentioned above, when a force Flt is applied to the ledge 155 or other component of the heel part 111, the sidewalls of the recess can slide relative to the surfaces of the ridge 147 until the ridge 147 exits the recess 177 to allow the rear of the footwear to transition to the open mode. As with the embodiment above, in some applications, the footwear can be configured to provide audible feedback indicating that the footwear is in a thoroughly locked closed mode, that is, the heel part and forefoot part are fully closed and engaged. In this closed mode, the footwear is ready for regular activity and use. To provide audible feedback, the heel lock ridge and heel lock recess can be configured to provide an audible snap as described in connection with the embodiment above.

Optionally, the midsole heel cup 146 can include one or more recesses 143 similar to the second recess noted in the embodiment above. This second recess 143 can receive a projection or ridge 173 of the second shank and its associated shank heel cup 176 to prevent relative forward and rearward movement or sliding of the second shank relative to the heel cup and/or midsole 140 when the footwear is in the closed mode. This construction, of course, can be reversed in some applications.

The footwear 10 shown in FIGS. 7-12 can include a wing chassis 180 that is similar or identical to the wing chassis 80 in the embodiment above. For example, the wing chassis 180 can include respective first 191 and second 192 wings that fit in respective first 127 and second 126 pockets disposed on the upper forefoot part 121. The wings 191 and 192 fitting in their respective pockets 126 and 127 can guide the opening and closing of the footwear from the open mode to the closed mode and vice versa. The wings in the pockets also can impair or prevent over extension of the heel part 111 relative to the forefoot part 117 and provide the other functionality described in connection with the wings and pockets in the embodiment above.

Figure 8A:
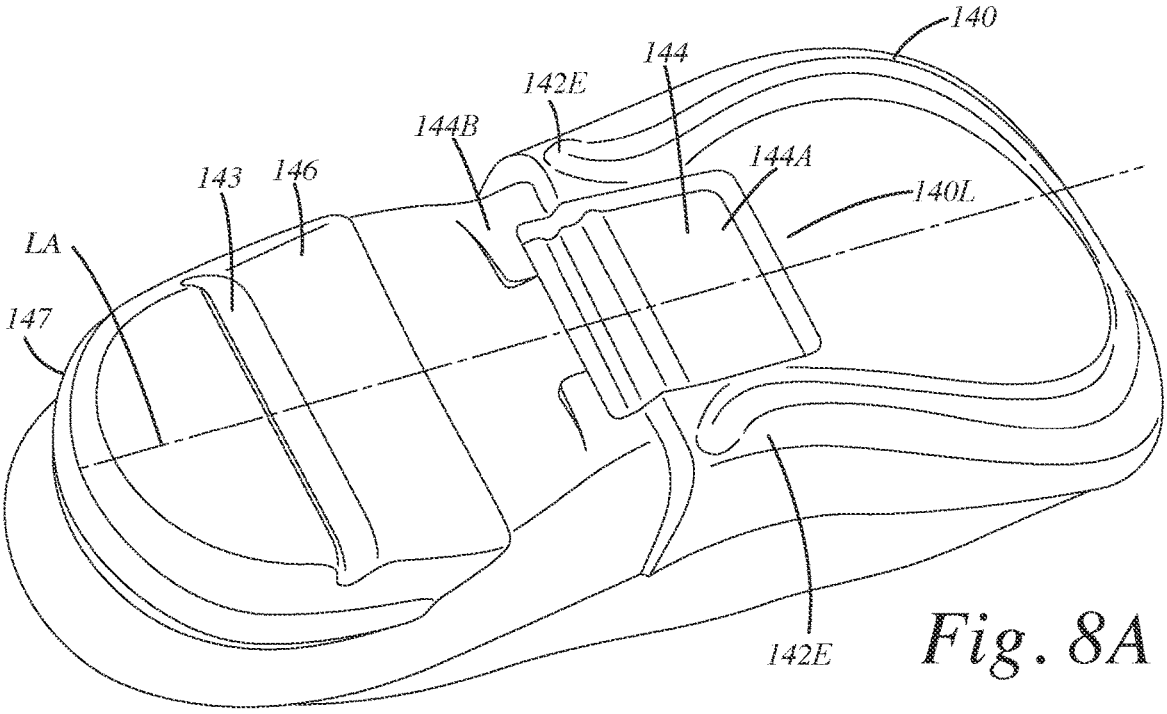
FIG. 8A is a bottom perspective view of a midsole.
Figure 8B:
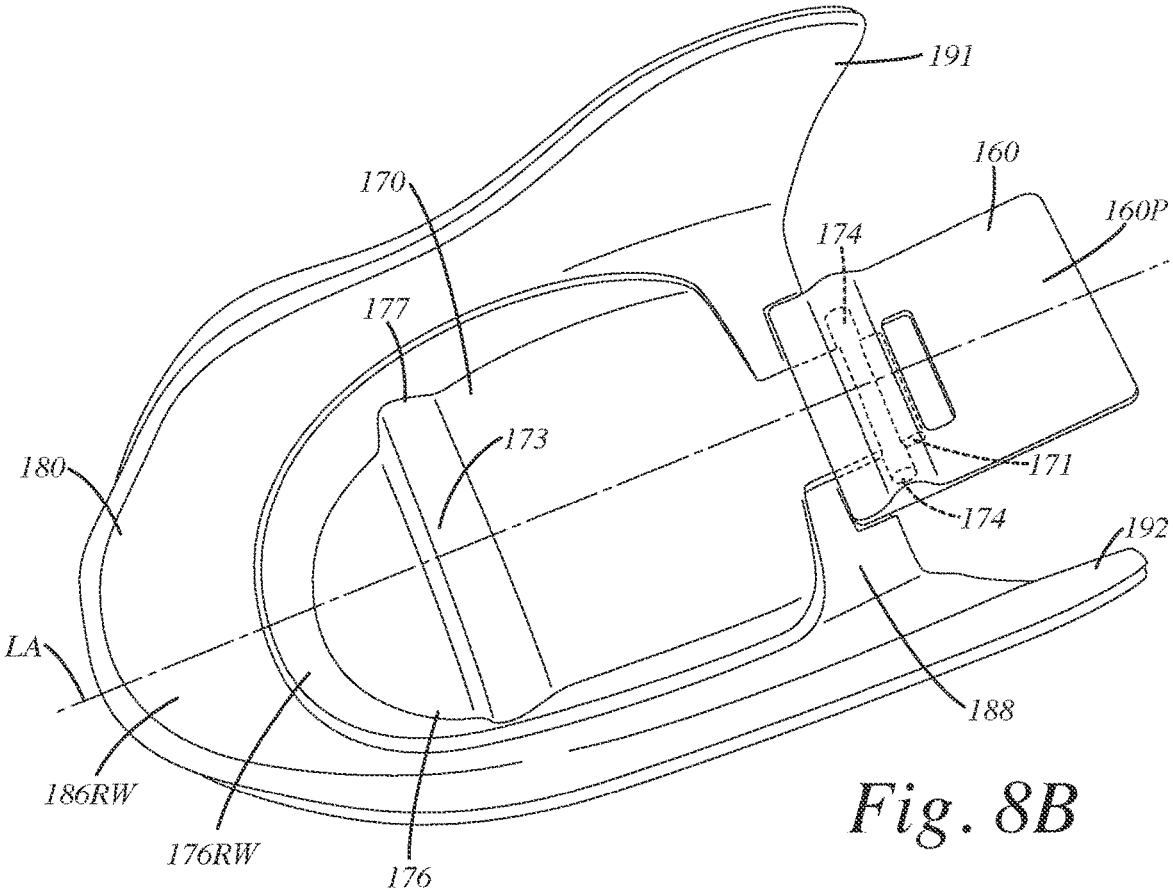
FIG. 8B is an upper perspective view of a rear heel part and a first and second shank connected via an axle.

The wing chassis 180 in this embodiment can be secured to the second shank 170. In particular, as shown in FIG. 8, the second shank 170 can be disposed in the recess 188 of the wing chassis 180. The heel cup 176 can extend downwardly into the recess 188 such that the rear wall 176RW extends upwardly along the rear wall 186RW of the wing chassis. In some applications, that rear wall 176RW can be entirely surrounded and enclosed within the rear wall 186 of the wing chassis. The wing chassis 180 can be constructed from a softer material than the shanks, such as EVA or some other foam or recycled material. The wings 191 and 192 may or may not be integrally formed with the remainder of the wing chassis 180 and the respective wall 186RW. In some cases, the wings 191 and 192 can be glued, adhered, cemented, welded or fastened with fasteners to the remainder of the wing chassis and/or the wall 186RW.

Figure 12:
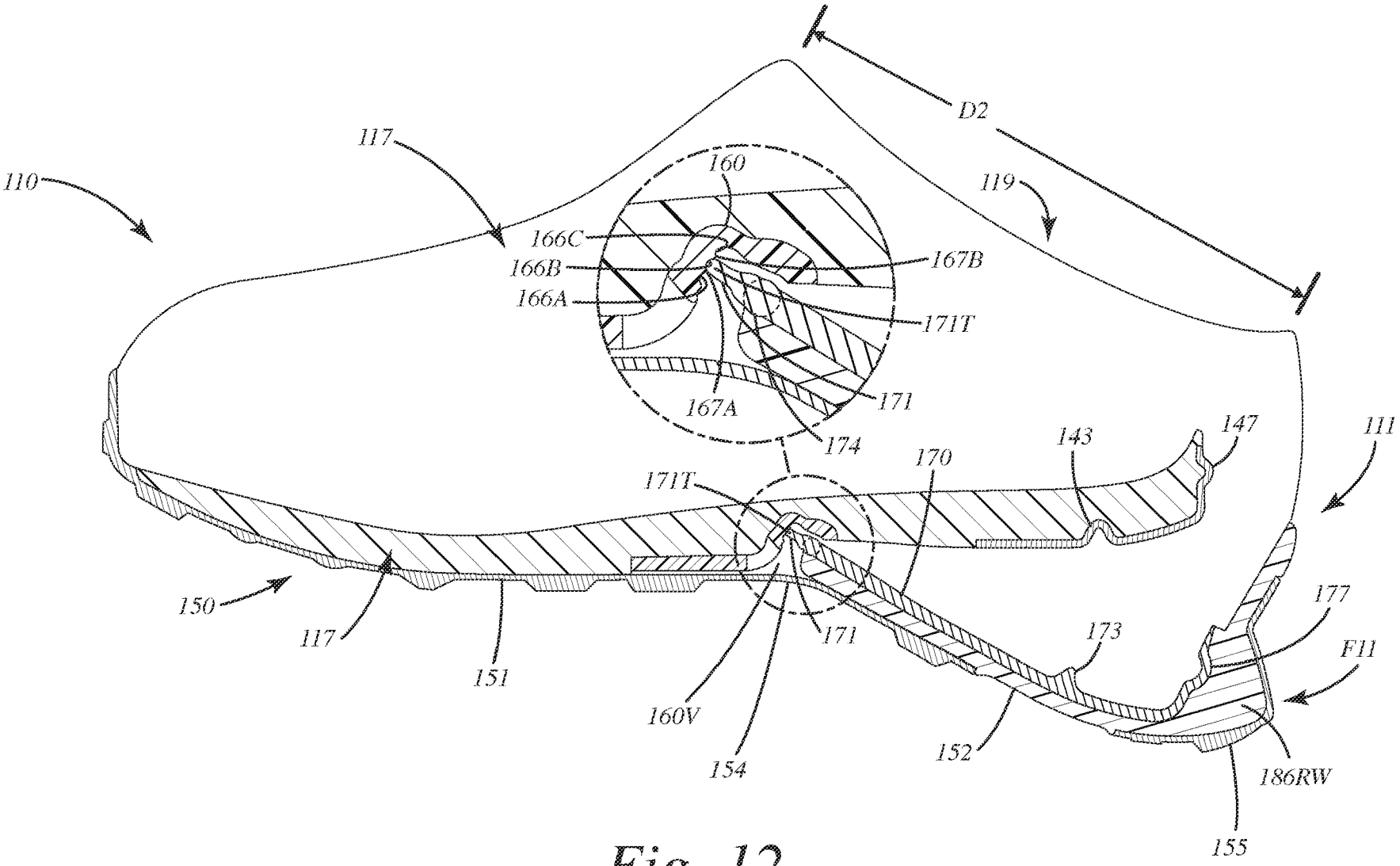
FIG. 12 is another section view of the first and second shanks locking the footwear in the open mode.

As mentioned above, the second shank 170 can include an associated shank heel cup 176. The shank heel cup 176 can project rearwardly and can include a rearward wall 176RW extending around a rear portion of the shank 170. This rear wall can transition to a bottom wall 176B that extends underfoot and in particular, under the heel of a wearer when the footwear is worn. Although not shown, the bottom wall 176B optionally can include or define a hole or an aperture centered on a longitudinal axis LA of the footwear or components thereof. The bottom wall 176B can be in the form of a plate that extends under the heel and forwardly toward the arch region. The bottom wall 176B can transition to a connector plate 172 of the shank 170. The connector plate 172 can have a width CP that is less than a width HPW of the second shank 170 at the greatest dimension of the second shank. The connector plate 172 can extend forward to an engagement rim 171. This engagement rim 171 can be similar to the engagement rim 71 described in the embodiment above, and can interact and engage the first recess 161 of the first shank 160, similar to the embodiment above. The engagement rim 171 in this construction also includes a tip 171T which can be rounded, angled or of another contour. As shown in FIG. 12, this tip 171T can selectively engage one or more of the plurality of recesses or valleys 166A, 166B, 166C of the first shank 160. The tip 171T can be moved to and positioned in individual ones of those recesses to effectively lock the second shank in a fixed position relative to the first shank. As a result, the heel part 111 attains a particular orientation and position relative to the forefoot part 117, in an open mode or closed mode. Each of the recesses 166A, 166B and 166C can be separated by corresponding ridges 167A, 167B. Optionally, there can be three different recesses to allow the second shank 170 to interact with the first shank 160 and hold the heel part 111 in a preselected orientation relative to the forefoot part 117. Of course, there can be fewer or more recesses and ridges depending on the various positions for the heel part relative to the forefoot part and the dimension of the opening when the footwear is in the open mode.

In transitioning from the closed mode in FIG. 11 to the open mode in FIG. 12, the tip 171T can slide over various ridges 167A, 167B, into and out from the various recesses 166A, 166B, 166C. As it does, the tip can slide or otherwise move across the ridges, sometimes making an audible snap so that a user can perceive that the reconfiguration of the footwear 110 from the closed mode to the open mode is occurring. Depending on their preference, the user also can correlate a particular number of audible snaps to the degree to which the user desires to have the heel part opened relative to the forefoot part. With the increased number of audible feedback units, the footwear can be opened to a greater dimension to allow the user to don or doff the footwear in a suitable manner according to their preference.

Figure 9:
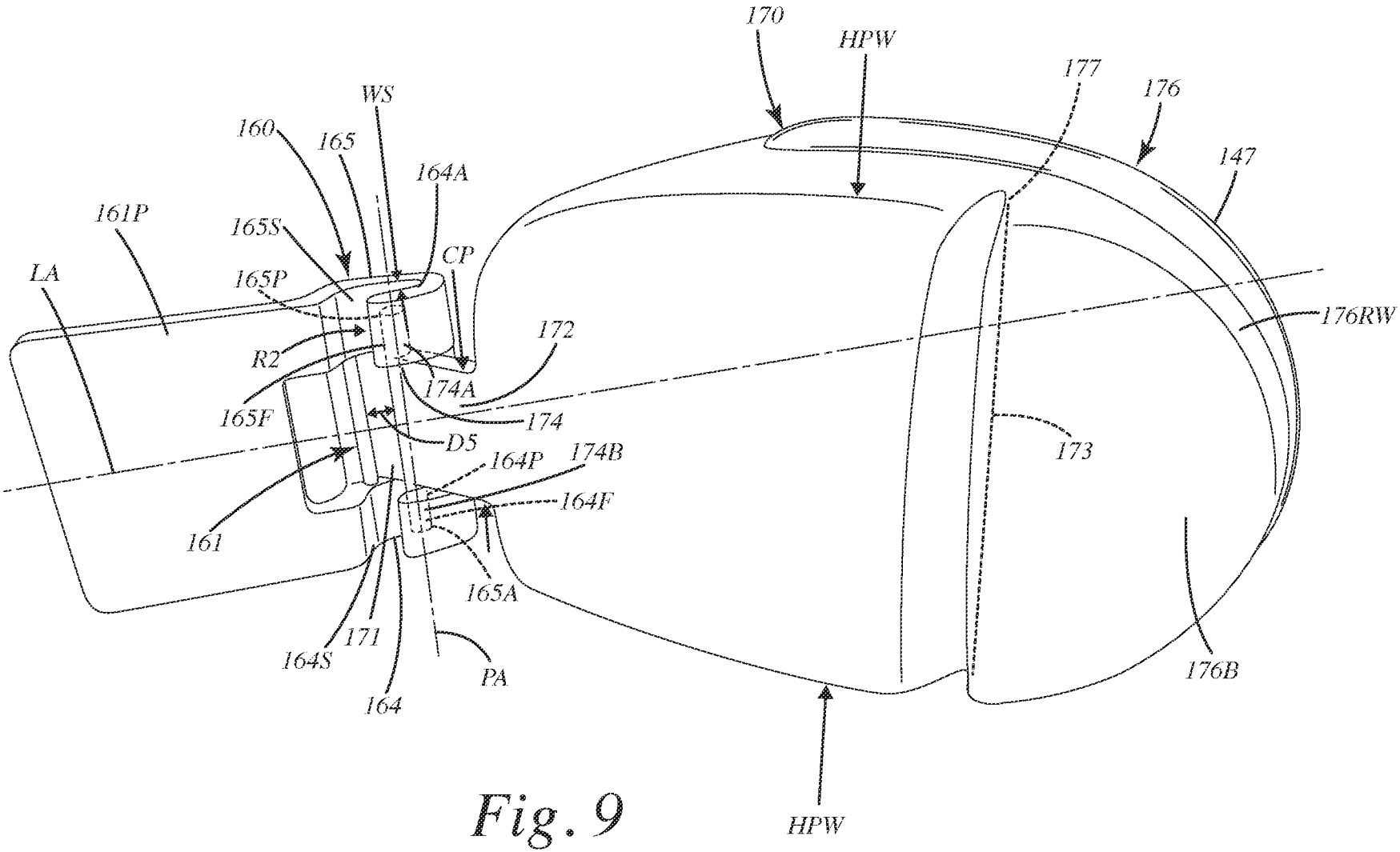
FIG. 9 is a bottom perspective view of the first and second shank connected via an axle.
Figure 10:
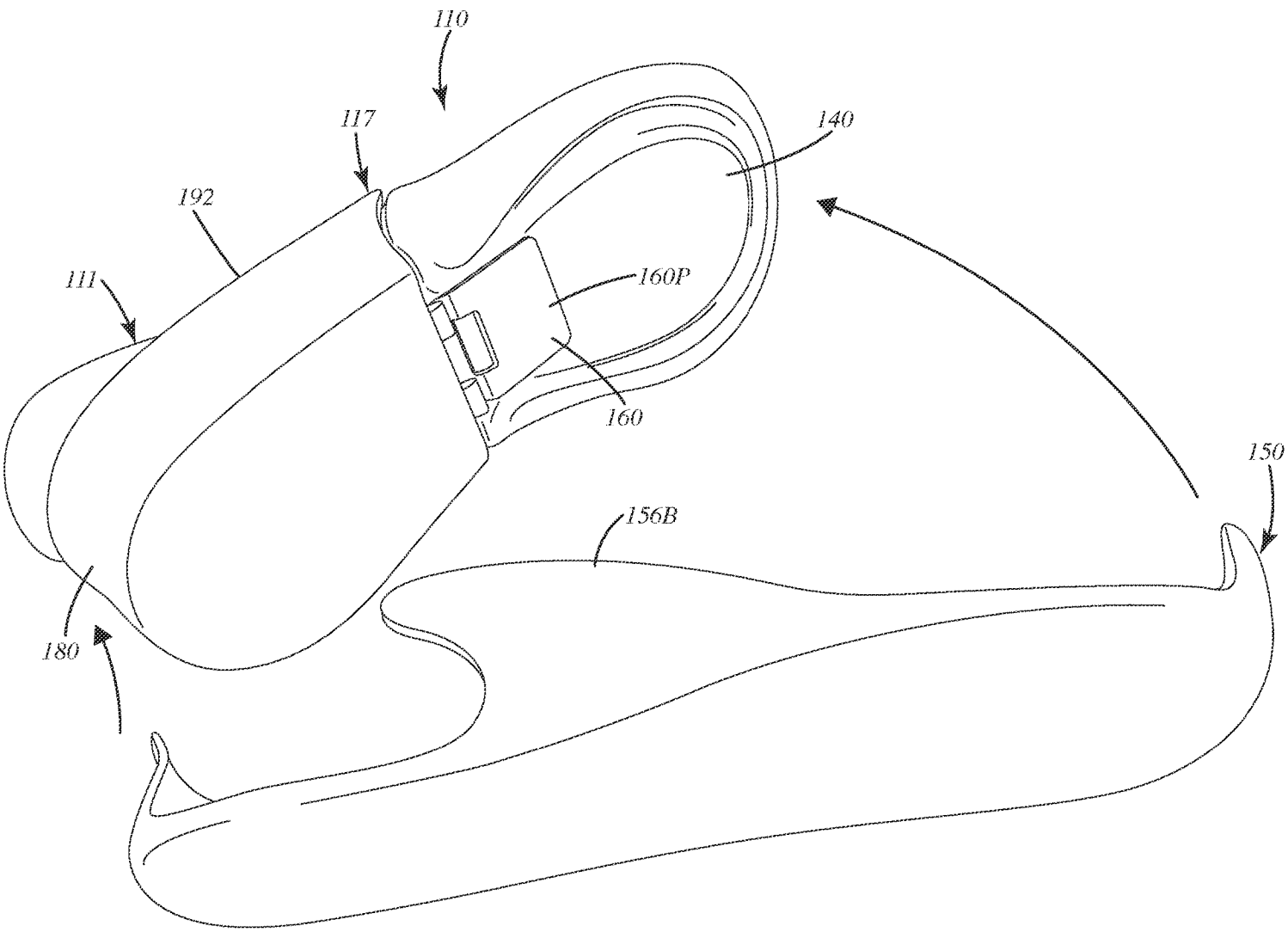
FIG. 10 is a bottom perspective view of the rear heel part and first shank joined with the midsole, with an outsole about to be added to the bottom of the midsole.

The first shank 160 and second shank 170 in this embodiment, shown in FIGS. 8, 9 and 10, can be positioned and located relative to one another in a manner different from that in the embodiment above. For example, in this embodiment, the first shank 160 and second shank 170 can be pivotally, rotatably, hingedly or otherwise movably secured to one another. This pivoting attachment can be accomplished in a variety of different manners. For example, as shown in FIG. 9, the first shank 160 can include first 164 and second 165 arms that project from a main plate 161P. The first recess 161 can be defined between the first and second arms 164 and 165. Each of the arms can include respective apertures 164A and 165A. These apertures can be coextensive with respective insertion slots 164S and 165S. These apertures 164A and 165A can be aligned across from one another, along a pivoting axis PA, on an opposite sides of the longitudinal axis LA as shown in FIG. 9. The respective apertures 164A and 165A can be configured to receive an axle 174. The axle 174 can be aligned with the pivot axis PA such that the axle can rotate about the pivot axis PA, and/or the second shank 170 can rotate relative to the first shank 160.

As illustrated in FIG. 9, the axle 174 can include a first pin 174A and a second pin 174B to project laterally away from the longitudinal axis LA., and away from the connector plate 172 that extends from the bottom plate 176B of the second shank 170. The first pin 174A and second pin 174B can be aligned with the axis PA. This axis PA can be set a distance D5 away from the engagement rim 171. This distance D5 can be optionally at least 1 mm, at least 2 mm, at least 3 m, at least 4 mm, at least 5 mm, at least 10 mm or more, depending on the application and the engagement of the engagement rim with the respective ridges and recesses in the first recesses 161. This distance can remain constant so that the rim does not move toward or away from the axis PA. The pins 174A and 174B can be captured in the respective apertures 164A and 165A of the respective arms 164 and 165. In particular, the arms 164 and 165 can include capture projections 164P and 165P. These capture projections can effectively trap the pins in them. The pins optionally can be of a cylindrical, rounded, elliptical or other shape disposed in the apertures.

Further optionally, the arms 164 and 165 can include fingers 164F and 165F that include the respective projections 164P and 165P. These fingers can be resilient and slightly bendable such that the pins can be slid into the apertures via the slots associated with the same. For example, the first pin 174A can be slid into the entry of the slot 165S in direction R2. As it continues in that slot it can eventually be pressed past the projection 165P. In so doing, the finger 165F can bend or flex slightly to increase the width WS of the slot such that the pin 174A can move past the projection and slip into the aperture 164A. When this occurs, the finger 165F can return to its prior unbent position to effectively trap the pin in the respective aperture.

In operation, for example, when the footwear transitions from a closed mode to an open mode, the pins 174A and 174B can rotate about the axis PA within the respective apertures 165A and 164A. As they do so, the engagement rim 171 can engage and/or disengage certain portions of the first recess 161 of the first shank until the prescribed orientation and configuration of the footwear in the open or closed mode is attained.

Although not shown, the axle 174 can come in a different form. For example, the connector plate 172 can define a through hole from one side to the other. The arms 164, 165 can include simple apertures without any connecting slots. A rod, constructed from plastic, metal and/or a composite, can be placed through the apertures and the through hole, extending from one arm to the other. The through hole can be slightly larger than the dimension of the rod such that the second shank 170 can rotate relative to the rod or axle, similar to the action provided by the pins in the embodiment shown in FIG. 9. Of course, other configurations can be utilized to provide a hinged, rotating, bending and/or pivoting movement between the second shank 170 and the first shank 160.

Figure 7:
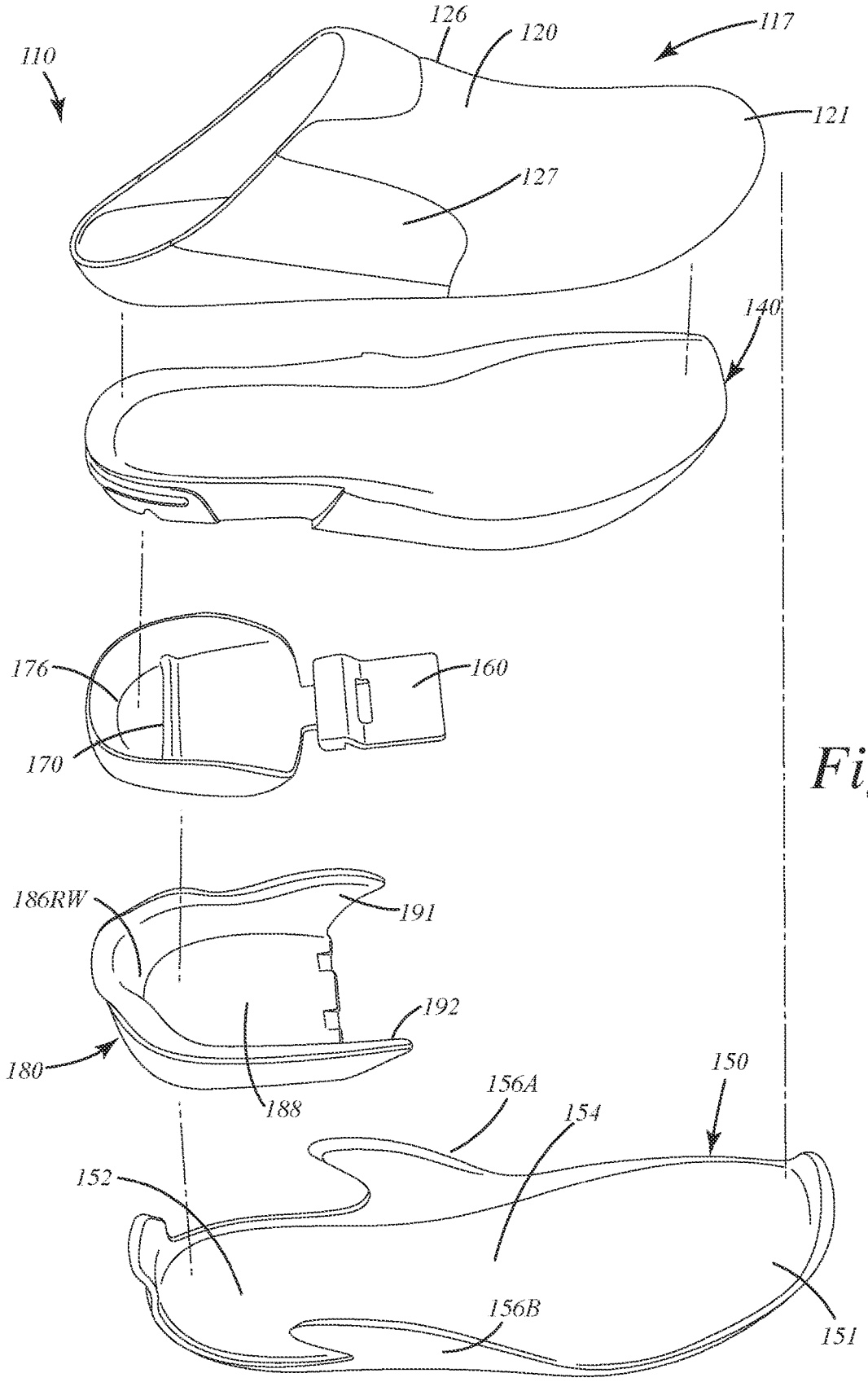
FIG. 7 is an exploded upper perspective view of a first alternative embodiment of the footwear and its components.

With reference to FIGS. 7 and 10, as mentioned above, the footwear 110 also can include an outsole 150. Similar to the embodiment described further above, this outsole 150 can be placed over the lower surface of the midsole 140 of the forefoot part 117, and can extend over the wing chassis 180 and/or second shank 170 under the heel part 111. The outsole 150 can include an outsole forefoot part 151 and outsole heel part 152. These outsole parts can be joined with a flex or transition region 154 which can be similar to the flex or transition region 54 described in the embodiment above.

Optionally, as also illustrated in FIG. 12, this flex or transition region can be substantially flat or planar, bridging and covering a void 160V that is defined between the respective first shank and second shank. This void can be substantially and/or entirely covered by the flex or transition region 154 of the outsole 150.

Further optionally, the outsole 150 can include a lateral and medial wings 156A and 156B. These wings can extend upwardly from the outsole near the flex or transition region 154 as shown in FIG. 7. The wings 156A and 156B optionally can cover and/or extend across a portion of the joint between the forefoot part 117 and the heel part 111 to provide a cleaner aesthetic and/or to prevent dirt, debris, water or other materials from entering into the void 160V and/or otherwise engaging the first and second shanks and the respective mechanical interactions between these two components.

As mentioned above, the embodiment illustrated in FIGS. 7-12 can function and operate similarly to the embodiment illustrated in FIGS. 1-6. Footwear effectively can be opened from a closed mode shown in FIG. 11 to an open mode shown in FIG. 12, to facilitate donning and doffing of the footwear 110 relative to user's foot.

The following additional statements about other current embodiments are provided, the lettering of which is not to be construed as designating levels of importance.

Statement A. Footwear is provided comprising an upper forefoot part, an upper heel part, an outsole including a forward part joined with the forefoot part and a rearward part joined with the heel part; wherein the rearward part is selectively moveable in unison with the heel part from a closed mode secured to a wearer's foot, to an open mode with the footwear open to don or doff the footwear.

Statement B. The footwear of statement A comprising: a first wing extending upward from the outsole on a medial side of the footwear and a second wing extending upward from the outsole on the lateral side of the footwear.

Statement C. The footwear of statement A or B, wherein the first wing and second wing register within respective first and second pockets joined with the upper forefoot part.

Statement D. The footwear of any preceding statement, wherein the first and second wings arch inwardly toward a longitudinal axis of the footwear in the closed mode, to assist in securing the footwear to a wearer's foot.

Statement E. The footwear of any preceding statement, wherein the first wing and second wing are rigidly secured to a rearward part of the outsole, and extend upward, and forward of the upper heel part, so that the first and second wings overlap respective first and second sides of the upper forefoot part.

Statement F. The footwear of any preceding statement, wherein the upper forefoot part includes a lateral pocket and a medial pocket, with the respective first wing and second wing slidably disposed in the lateral pocket and the medial pocket.

Statement G. The footwear of any preceding statement, wherein the first wing interferes with the first pocket in transitioning to the open mode to impair further opening of the upper heel part relative to the upper forefoot part.

Statement H. The footwear of any preceding statement, wherein the first wing includes an upper edge and the first pocket includes an inside upper perimeter, wherein the upper edge engages the inside upper perimeter to cease further opening of the upper heel part relative to the upper forefoot part.

Statement I. The footwear of any preceding statement, wherein the first wing and the second wing each curve inward toward one another over a portion of an instep of the upper to cooperatively secure the footwear in the closed mode.

Statement J. The footwear of any preceding statement, wherein the first wing includes a first end and a second end, the first end secured to the rearward heel part, the second end extending in the first pocket, wherein the second end extends inwardly toward a longitudinal axis of the upper, wherein the second end is closer to the longitudinal axis than the first end.

Statement K. The footwear of any preceding statement, wherein the second wing includes a first end and a second end, the first end of the second wing secured to the rearward heel part, the second end extending in the second pocket, wherein the second end of the second wing extends inwardly toward the longitudinal axis of the upper and toward the second end of the first wing, wherein the second end of the second wing is closer to the longitudinal axis than the first end of the second wing.

Statement L. The footwear of any preceding statement, comprising a wing chassis, wherein a first wing and a second wing project upwardly and away from the wing chassis on opposite sides of the longitudinal axis, wherein the wing chassis includes a base plate connecting the first and second wings.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A footwear construction comprising:

an upper forefoot part defining a pocket;

a midsole joined with the upper forefoot part and extending rearward from an arch region into a heel region;

an upper heel part joined with a wing that is moveable within the pocket, the upper heel part being disposed in the heel region;

an outsole including a forward part fixedly joined with the midsole under the upper forefoot part, the outsole including a rearward part joined with the upper heel part;

a first shank defining a first recess, the first shank extending rearward under the midsole; and a second shank including an engagement rim, the second shank adjacent the midsole, wherein the rearward part of the outsole is selectively moveable in unison with the upper heel part from a closed mode in which the footwear is secured to a wearer's foot, to an open mode in which the footwear is open so that the wearer can don or doff the footwear, wherein the second shank is configured to tilt away from the midsole in transitioning to the open mode, with the engagement rim registering in the first recess to stabilize the footwear in the open mode so that the footwear remains in the open mode, wherein the second shank is configured to tilt toward the midsole in transitioning to the closed mode, with the engagement rim exiting the first recess in transitioning to the closed mode, wherein the wing projects farther into the pocket in the closed mode than in the open mode.

2. The footwear construction of claim 1, wherein a majority of the wing is registered in the pocket when the footwear is in the closed mode, wherein a minority of the wing is disposed in the pocket when the footwear is in the open mode.

3. The footwear construction of claim 1, wherein the midsole includes a rear sidewall and a heel lock ridge that projects at least 110 degrees about the rear sidewall, wherein the second shank includes a rearward band that projects upward and includes a heel lock recess, wherein the heel lock ridge snaps into the heel lock recess when the closed mode is attained.

4. The footwear construction of claim 1, wherein the pocket includes a first inner surface and a second inner surface facing toward one another and defining a void, wherein the wing is disposed in the void between the first inner surface and the second inner surface.

5. The footwear construction of claim 1 comprising:

a second recess defined in the midsole rearward of the first recess, wherein a chassis projection is selectively registerable in the second recess to impair sliding of the second shank relative to the midsole in the closed mode.

6. The footwear construction of claim 1, wherein a majority of the wing is disposed in the pocket in the closed mode, wherein the wing curves inward over a portion of an instep of the upper in the closed mode.

7. The footwear construction of claim 1, wherein the second shank includes an upwardly projecting band that extends upward along and directly engages a rear sidewall of the midsole in the closed mode, wherein the outsole includes a rear sidewall that is located adjacent and moves with the upwardly projecting band in transitioning from the closed mode to the open mode.

8. The footwear construction of claim 1, wherein the pocket is located on the medial side of a longitudinal axis of the footwear, wherein the wing is located on the medial side of the longitudinal axis, wherein the pocket includes a stop wall, wherein the wing engages the stop wall in the open mode to impair the upper heel part from overextending relative to the upper forefoot part.

9. The footwear construction of claim 8 comprising:

another pocket that is located on the lateral side of the longitudinal axis across from the pocket located on the medial side of the longitudinal axis; and an additional wing that is located on the lateral side of the longitudinal axis across from the wing located on the medial side of the longitudinal axis, and slidably disposed in the other pocket.

10. The footwear construction of claim 9, wherein the wing and the additional wing exert a force on the portion of the instep to cooperatively secure the footwear in the closed mode.

11. A footwear construction comprising:

an upper forefoot part defining a first pocket and a second pocket on opposite sides of a longitudinal axis;

an upper heel part joined with a first wing and a second wing respectively registered in the first pocket and the second pocket, the upper heel part being disposed in a heel region;

an outsole including a forward part fixedly disposed under the upper forefoot part and a rearward part joined with the upper heel part;

wherein the rearward part is selectively moveable in unison with the upper heel part from a closed mode in which the footwear is secured to a wearer's foot, to an open mode in which the footwear is open so that the wearer can don or doff the footwear, wherein the first wing projects farther into the first pocket in the closed mode than in the open mode, wherein the second wing projects farther into the second pocket in the closed mode than in the open mode, wherein the first wing and the second wing each curve inward toward one another over a portion of an instep of the upper to cooperatively secure the footwear in the closed mode.

12. The footwear construction of claim 11, wherein the first pocket includes a first interior panel that faces toward a wearer's foot and a first exterior panel that is spaced from the first interior panel and joined with the first exterior panel, wherein the first wing is slidably disposed between the first interior panel and the first exterior panel, wherein the second pocket includes a second interior panel that faces toward a wearer's foot and a second exterior panel that is spaced from the second interior panel and joined with the second exterior panel, wherein the second wing is slidably disposed between the second interior panel and the second exterior panel.

13. The footwear construction of claim 11, wherein the first wing includes a first end and a second end, the first end joined with the rearward heel part, the second end extending in the first pocket, wherein the first pocket includes a front wall and a rear wall, wherein the rear wall is closer to a collar of the upper forefoot part than the front wall, wherein the second end of the first wing moves toward the rear wall in transitioning to the open mode and engages the rear wall of the first pocket in the open mode to impair the upper heel part from being overextended relative to the upper forefoot part.

14. The footwear construction of claim 13, wherein the second wing includes a first end and a second end, the first end of the second wing joined with the rearward heel part, the second end of the second wing extending in the second pocket, wherein the second pocket includes a front wall and a rear wall, wherein the rear wall of the second pocket is closer to the collar of the upper forefoot part than the front wall of the second pocket, wherein the second end of the second wing moves toward the rear wall of the second pocket in transitioning to the open mode and engages the rear wall of the second pocket in the open mode to impair the upper heel part from being overextended relative to the upper forefoot part.

15. The footwear construction of claim 11, comprising:

a first shank defining a first recess, the first shank being disposed below the upper heel part; and a second shank including an engagement rim, wherein the second shank is configured to tilt downward in transitioning to the open mode, with the engagement rim registering in the first recess to stabilize the footwear in the open mode so that the footwear remains in the open mode, wherein the second shank is configured to tilt upward in transitioning to the closed mode, with the engagement rim exiting the first recess in transitioning to the closed mode.

16. The footwear construction of claim 11, wherein the first wing and the second wing each engage a rear wall of the respective first and second pockets to impair the upper heel part from overextending relative to the upper forefoot part.

17. A footwear construction comprising:

an upper forefoot part;

a midsole joined with the upper forefoot part and extending rearward therefrom into a heel region;

an upper heel part disposed in the heel region;

an outsole including a forward part fixedly joined with the midsole under the upper forefoot part, the outsole including a rearward part joined with the upper heel part;

a first shank extending forward under the upper forefoot part; and a second shank extending rearward under the upper heel part, wherein the rearward part is selectively moveable in unison with the upper heel part from a closed mode in which the footwear is secured to a wearer's foot, to an open mode in which the footwear is open so that the wearer can don or doff the footwear, wherein the second shank is configured to tilt away from the midsole in transitioning to the open mode, wherein the second shank is configured to tilt toward the midsole in transitioning to the closed mode, wherein the second shank tilts relative to the first shank in transitioning to at least one of the open mode and the closed mode, wherein the second shank includes an engagement rim, wherein the engagement rim registers in the first recess to stabilize the footwear in the open mode so that the footwear remains in the open mode, wherein the engagement rim exits a first recess of the first shank in transitioning to the closed mode, wherein the upper forefoot part defines a first pocket and a second pocket on opposite sides of a longitudinal axis;

wherein the upper heel part is joined with a first wing and a second wing respectively registered in the first pocket and the second pocket, wherein the first wing projects farther into the first pocket in the closed mode than in the open mode, wherein the second wing projects farther into the second pocket in the closed mode than in the open mode.

* * * * *